United States Patent [19]

Ito et al.

[11] 4,234,534

[45] Nov. 18, 1980

[54] METHOD AND APPARATUS FOR MANUFACTURING ARTICLES OF HYDRAULIC SUBSTANCES

[75] Inventors: Yasuro Ito, No. 4-38-16, Numabukuro, Nakano-ku, Tokyo, Japan; Hideharu Kaga, Tokyo, Japan; Yasuhiro Yamamoto, Kawasaki, Japan; Tadayuki Sumita, Tokyo, Japan

[73] Assignees: Yasuro Ito; Taisei Corporation, both of Tokyo, Japan

[21] Appl. No.: 899,849

[22] Filed: Apr. 25, 1978

Related U.S. Application Data

[63] Continuation of Ser. No. 558,165, Mar. 13, 1975, abandoned.

[30] Foreign Application Priority Data

| | | | |
|---|---|---|---|
| Mar. 13, 1974 | [JP] | Japan | 49/28025 |
| Feb. 14, 1975 | [JP] | Japan | 50/19736[U] |
| Feb. 14, 1975 | [JP] | Japan | 50/19737[U] |
| Feb. 17, 1975 | [JP] | Japan | 50/18709 |
| Feb. 25, 1975 | [JP] | Japan | 50/23035 |

[51] Int. Cl.[3] ..... B28B 1/24

[52] U.S. Cl. ..... 264/328.8; 264/333

[58] Field of Search ..... 264/333, 101, 297, 79, 264/328; 425/243, 250

[56] References Cited

U.S. PATENT DOCUMENTS

| | | | |
|---|---|---|---|
| 1,332,457 | 3/1920 | Burkhardt | 264/DIG. 57 |
| 3,257,338 | 6/1968 | Sefton et al. | 264/DIG. 57 |
| 3,875,278 | 4/1975 | Brandt | 264/90 |

FOREIGN PATENT DOCUMENTS

| | | |
|---|---|---|
| 1391153 | 1/1965 | France . |
| 1173319 | 12/1969 | United Kingdom . |

*Primary Examiner*—John A. Parrish

*Attorney, Agent, or Firm*—Birch, Stewart, Kolasch & Birch

[57] ABSTRACT

A plurality of moulds each including a side frame and a hollow bed overlying the side frame are vertically stacked with sealing members interposed between the beds and the side frames for hermetically sealing the moulds. While the pressure in the moulds is being reduced a hydraulic substance such as cememt is poured into the moulds. The poured hydraulic substance is heat cured to produce solid articles releasable from the moulds. An empty mould is added to one side of the stack while a mould containing the cured substance is removed from the other side of the stack. Alternatively, the process can be carried out according to a batch system. The moulds may be packed with aggregate, fittings or means for interconnecting the articles.

32 Claims, 24 Drawing Figures

METHOD AND APPARATUS FOR MANUFACTURING ARTICLES OF HYDRAULIC SUBSTANCES

This application is a continuation of copending application Ser. No. 558,165, filed on Mar. 13, 1975, now abandoned.

BACKGROUND OF THE INVENTION

The present invention relates to a method and apparatus for manufacturing articles of hydraulic substances.

Various types of methods of manufacturing articles of hydraulic substances such as cements, for example Portland cement, plasters, and calcium silicate have been proposed in the past. The method of manufacturing articles of hydraulic substances generally comprises a plurality of steps including compounding raw materials, pouring the raw materials into a mould, pretreating of the mould, surface finishing of the article and accelerating the curing of the article. Accordingly, in order to sequentially perform such plurality of process steps, it is necessary to use very large equipment installed at a large site. In modern industry, such process steps should be made in a flow system. The curing treatment or the curing acceleration treatment of the products requires at least several hours or more because hydration reaction should be suitably advanced and sludge like substance mixed with the water should be hardened to a hardness permitting removal of the hardened products from the mould. Such increase in the treatment time increases the area of the site required for the flow system. Furthermore, in order to accomplish the curing treatment in several hours it is necessary to preset particular heating and pressurizing conditions thus requiring a large installation. Although the articles of the type described above are used as structural component elements for fabricating buildings and structures and manifest high compression strength, their tensile strength is considerably smaller than metals as is well known in the art. For this reason, it is necessary to embed reinforming steel rods in the products. Moreover, for the purpose of providing for sun light and wind and for passing conduits for electric cables town gas, water and sewage water, etc., through the walls, it is usual to incorporate window frames and various pipings into the moulded articles of hydraulic substances. Further, connecting members of fixtures are also incorporated into the articles for the purpose of interconnecting them or mounting attachments thereon. For this reason, it is advantageous to mould the articles of hydraulic substances which generally take the form of flat plates, with their wider side surfaces opened. When the articles are moulded with their narrower side surfaces opened it is difficult to correctly embed such connecting members or fixtures, and in some cases it is impossible to do so. This requires a large amount of labor and processing steps. Where moulds are arranged in a flow system with their wider side surfaces opened, a large site and large equipment are required which makes installation and operation expensive. Modern factories designed for mass production of large concrete articles require sites of several thousands square meters and several tens employees or more.

SUMMARY OF THE INVENTION

It is the principal of the present invention to provide a novel method and apparatus for manufacturing articles of hydraulic substances such as cements including Portland cement, silica cement, alumina cement, blast furnace cement, flyash cement and slag cement, plasters, calcium silicate, etc., which can obviate the difficulties of the prior art methods and can manufacture products of desired shape and characteristics with a relatively small equipment and with a small number of employees.

Another object of the present invention is to provide a new and improved method and apparatus which can manufacture articles of hydraulic substances in a short time which have a large mechanical strength and can be readily removed from the moulds.

Still another object of the present invention is to provide a novel method and apparatus capable of manufacturing, on a mass production scale, articles of hydraulic substances of various sizes and configurations in a limited space such as a site close to or even in a partially built building.

A further object of the present invention is to provide an improved method and apparatus for manufacturing articles of hydraulic substances wherein the substance is poured in the mould while the pressure in the mould is reduced thereby increasing the density of the moulded articles.

A still further object of the present invention is to provide portable apparatus for manufacturing articles of hydraulic substances which can be readily assembled, disassembled and transported to any desired site.

Another object of the present invention is to provide a novel apparatus for manufacturing articles of hydraulic substances which utilizes beds composed of a plurality of units.

Another object of the present invention is to provide a method and apparatus for manufacturing articles of hydraulic substances which do not generate noise during operation.

According to one aspect of the present invention there is provided a method of manufacturing an article of hydraulic substance comprising the steps of vertically stacking a plurality of moulds each including a side frame and a hollow bed plate overlying the side frame, interposing a sealing member between the beds and the side frames for tightly closing the moulds in an airtight manner reducing the pressure in the moulds, pouring the hydraulic material into the moulds under a reduced pressure condition, heat curing the poured hydraulic substance and releasing the cured articles from the moulds.

Another object of the present invention is to provide apparatus for manufacturing an article of hydraulic substance including means for cleaning the pouring pipe for pouring the hydraulic substance thus preventing solidified hydraulic substance from clogging the pouring pipe.

According to another object of the present invention there is provided an apparatus for manufacturing articles of hydraulic substance comprising a vertical stack of a plurality of moulds, each including a side frame and a hollow bed overlying the side frame, sealing means interposed between the side frames and the beds for hermetically sealing the moulds, means for releasably interconnecting the stacked moulds, means for reducing the pressure in the moulds, means for pouring the hydraulic substance into the moulds, and means for admitting a heating medium into the hollow beds for heat curing the hydraulic substance poured into the moulds.

The upper and bottom surfaces of the bed may be flat or arcuate so as to manufacture flat plates or arcuate plates.

Other objects and further scope of applicability of the present invention will become apparent from the detailed description given hereinafter; it should be understood, however, that the detailed description and specific examples, while indicating preferred embodiments of the invention, are given by way of illustration only, since various changes and modifications within the spirit and scope of the invention will become apparent to those skilled in the art from this detailed description.

In operation, an empty mould is added to one side of the stack while another mould containing a cured article is removed from the other side of the stack thus continuously manufacturing a number of articles on a mass production scale.

Since a plurality of moulds are stacked in the vertical direction, the apparatus occupies only a limited floor space so that the apparatus can be installed or transported to any desired site near a building under construction or even on a floor of a partially fabricated building. Furthermore, the mould is open at its wider side so that it is easy to introduce aggregate thereto, and to mount therein reinforcing steel bars, pipes, fittings, window frames or means for interconnecting the completed articles. If desired layers of heat insulating, heat preserving or sound absorbing material may be disposed in the mould before pouring of the hydraulic substance.

Further, as a number of moulds are stacked in the vertical direction, the hydraulic substance charged in respective moulds acts as a heat insulator thus establishing an optimum temperature gradient along the height of the stack. As a consequence, it is not necessary to use a heat insulated chamber for heat curing the poured hyraulic substance and then cooling the cured products. Even when pressure is applied to the poured hydraulic substance during curing, the layers of such poured substance act as a cushion for the applied pressure thereby eliminating the use of means for resisting such applied pressure.

An important feature of the present invention lies in the reduction of the pressure in the mould during pouring of the hydraulic substance. This facilitates pouring the hydraulic substance in closed moulds by a difference between the atmospheric pressure and the reduced pressure prevailing in the moulds. Moreover, it is possible to remove air entrained in the hydraulic substance (usually about 2 to 3% of air is entrained) and excessive moisture as well as the air in the interstices between coarse or light weight aggregate packed in the moulds thereby increasing the density and compression strength of the products. In addition, when heat is applied for curing, a pressure higher than the atmospheric pressure is created in the mould thus further compacting the poured hydraulic substance. For example, when the moulds are heated to about 100° C. a pressure of about 1 $Kg/cm^2$ will be created in the moulds. Supposing that the pressure in the moulds is reduced to 0.1 $Kg/cm^2$, the material used to fabricate the moulds is required to withstand to a pressure of about 2.0 $Kg/cm^2$. Since it is possible to successively pour the hydraulic substance into the stacked moulds the temperature difference between one mould whose internal pressure has been reduced to 0.1 $Kg/cm^2$ and an adjacent mould which is heated for curing is at most 30° C. so that the maximum pressure of expansion would be less than 0.2 $Kg/cm^2$. Accordingly, the pressure difference acting upon the material comprising the moulds would be about 1.1 $Kg/cm^2$. As the curing temperature is increased to about 80° C., the pressure of expansion would be about 0.5 $Kg/cm^2$ and the pressure differential to which the material is subjected is only 6.3 $Kg/cm^2$. In other words, the material is required to withstand to a pressure of only 1 $Kg/cm^2$. This decreases the weight and size of the apparatus.

It is advantageous that the sealing member interposed between the bed and the mould comprises an inner sealing member for preventing the leakage of the poured hydraulic substance and an outer sealing member for preventing the leakage of air. The space between the inner and outer sealing members is connected to a source of reduce pressure or a source of pressure for establishing a desirable pressure gradient between the inside and outside of the moulds. If the inner sealing member is made of metal, it will not be damaged by the concrete poured in the mould, and the concrete deposited on the metal sealing member can readily be wiped off.

Generally speaking, the apparatus of the present invention requires a floor space of only about twice the surface area of the products being manufactured. For example, where the products have a surface area of several square meters, the floor space required is usually less than about 20 $m^2$.

For making easy to assemble, disassemble and transport the bed, according to another feature of the present invention, the bed is composed of a plurality of split bed units which are joined together into a unitary structure.

In the prior method of manufacturing concrete articles, it is usual to apply vibration to the mould for densely compacting the mixture of aggregate and hydraulic substance. However, such vibration generates objectional noise. As described hereinabove, according to the present invention since the pressure in the mould is reduced and then the hydraulic substance is poured into the mould under the pressure difference between the reduced pressure and the atmospheric pressure it is possible to produce dense products without applying any vibration to the mould. If desired, after pouring the hydraulic substance in the mould the pressure therein may be increased beyond atmospheric pressure for further compacting the poured hydraulic substance.

BRIEF DESCRIPTION OF THE DRAWINGS

Further objects and advantages of present invention can be more fully understood from the following detailed description taken in conjunction with the accompanying drawings wherein.

DESCRIPTION OF THE PREFERRED EMBODIMENTS

Figure 1:
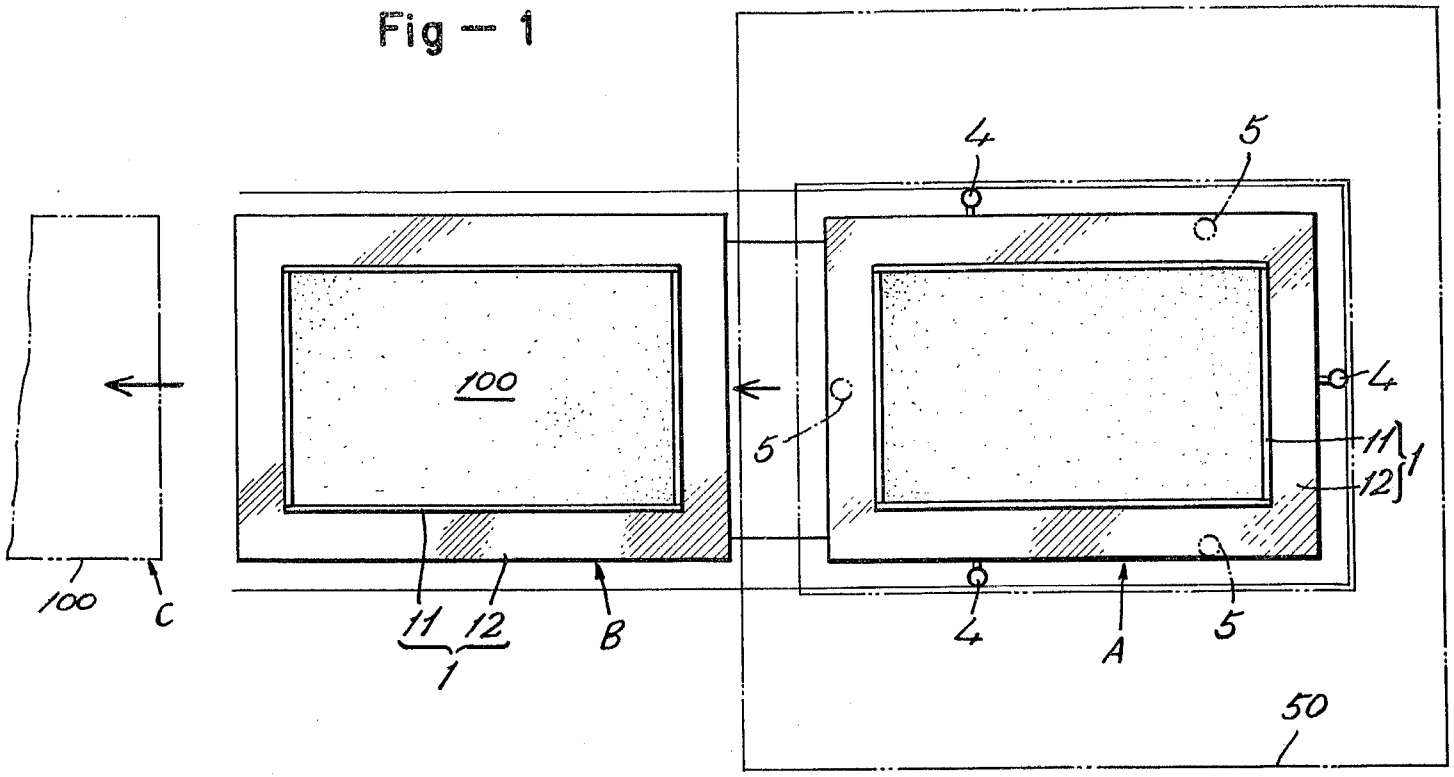
FIG. 1 is a plan view of the apparatus embodying the present invention which is suitable for a continuous operation.
Figure 2:
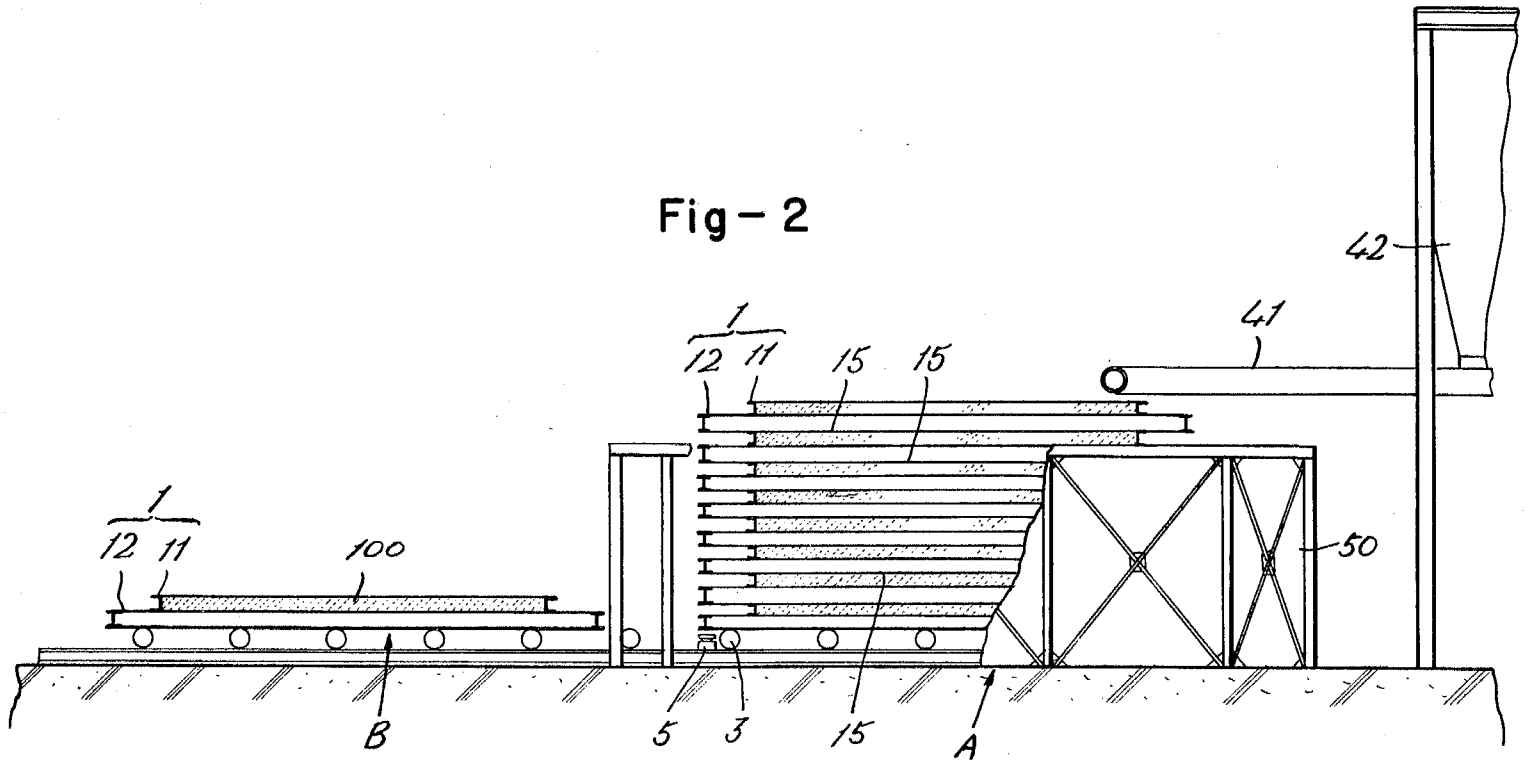
FIG. 2 is a side view, partly in section, of the apparatus shown in FIG. 1.

The embodiment of the present invention illustrated in FIGS. 1 and 2 is suitable for a continuous production system and the details of the apparatus is shown in FIGS. 3 through 10.

A loading mechanism 41 as shown in FIG. 2 is provided on one side of a moulding station A surrounded by suitable walls 50 for loading a hydraulic substance from a hopper 42 into moulds 1. Each mould 1 comprises a side frame 11 and a hollow bed 12 including a bottom plate 15. In the moulding station A, a plurality of moulds 1 are piled up, and the hydraulic substance is poured in the uppermost mould 1. A conveyor 3 shown as a roller conveyor is disposed beneath the lowermost mould 1 for transferring the lowermost mould to a releasing station B on one side of the moulding station for removing a completed product 100 from the mould 1. At this time, the product has been sufficiently cured and can be readily removed from the mould. The removed products 100 are transferred to station C where the products are piled up for transportation. Three supports 4 are provided along the periphery of each mould 1 for removing the same. Further, three elevating means such as jacks 5 are also provided along the periphery of each mould. The construction and operation of the supports 4 and the jacks 5 will be described later in detail.

Figure 3:
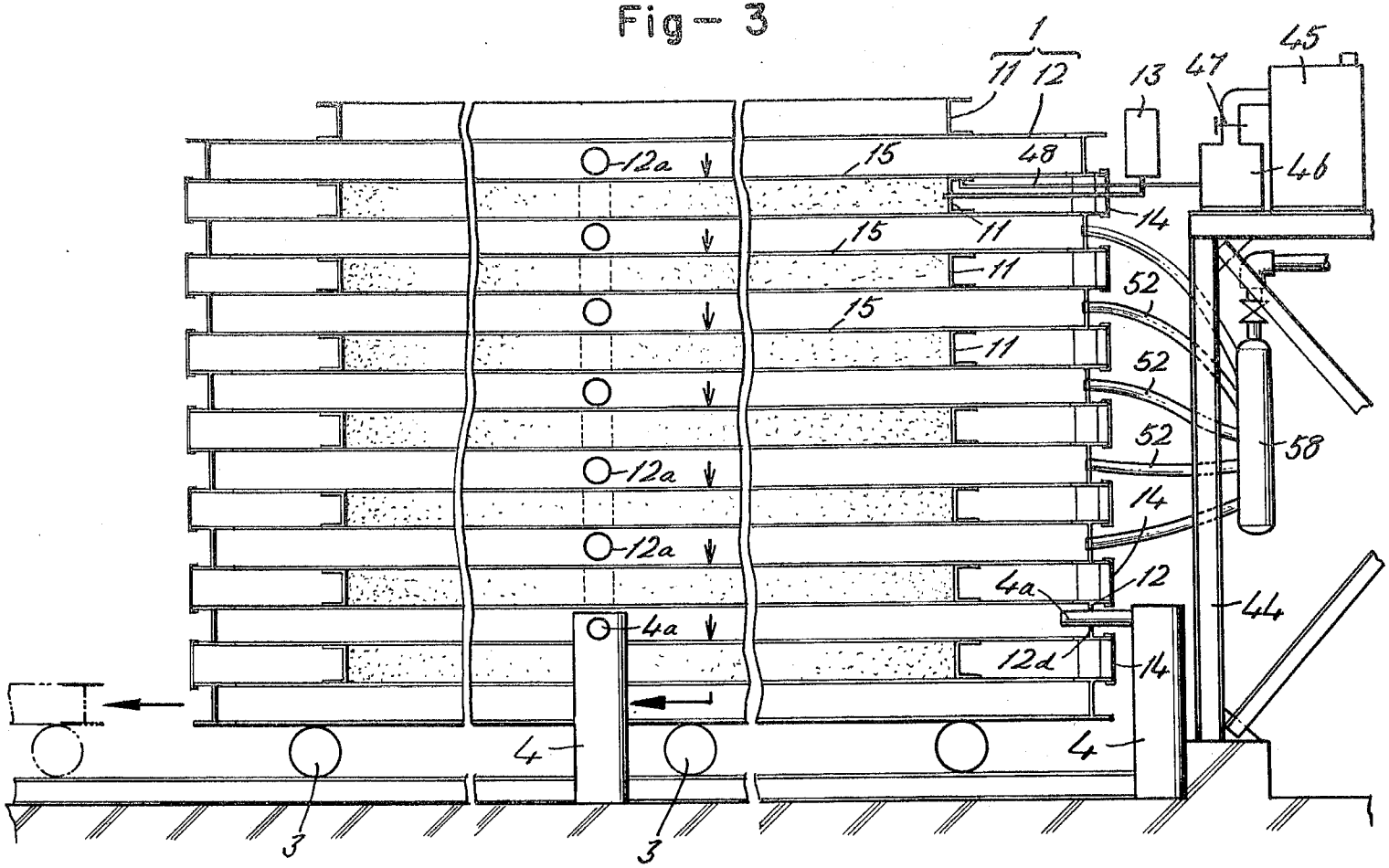
FIG. 3 is a side view showing a group of stacked moulds, a pressure reducing mechanism, and a heat curing means utilized in the apparatus shown in FIGS. 1 and 2.

FIG. 3 shows the detail of the moulding station A. As shown, the coarse aggregate is loaded into respective side frames 15 by means of the loading mechanism 41. Another loading mechanism 13 is provided for loading into the moulds 1 mortar of a hydraulic substance, for example, paste like cement.

Figure 4:
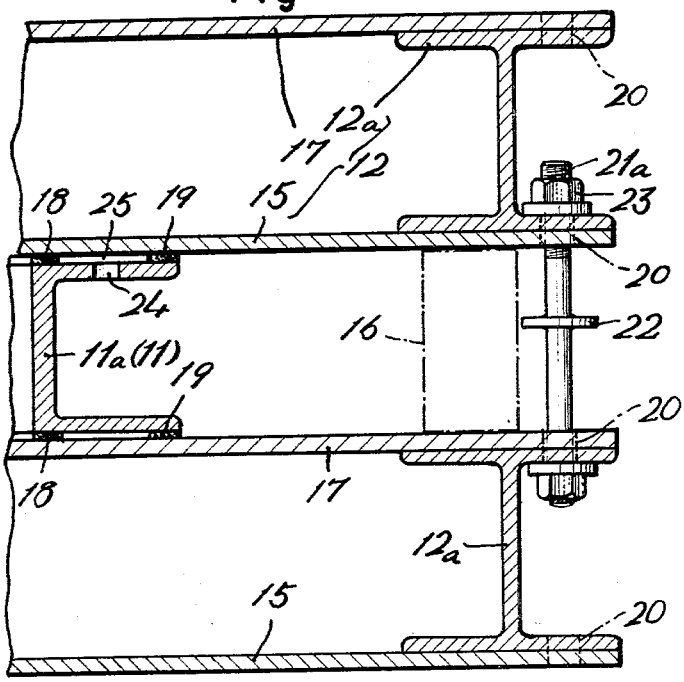
FIG. 4 is a partial sectional view showing a connecting member and sealing members utilized in the apparatus shown in FIGS. 1 and 2.
Figure 5:
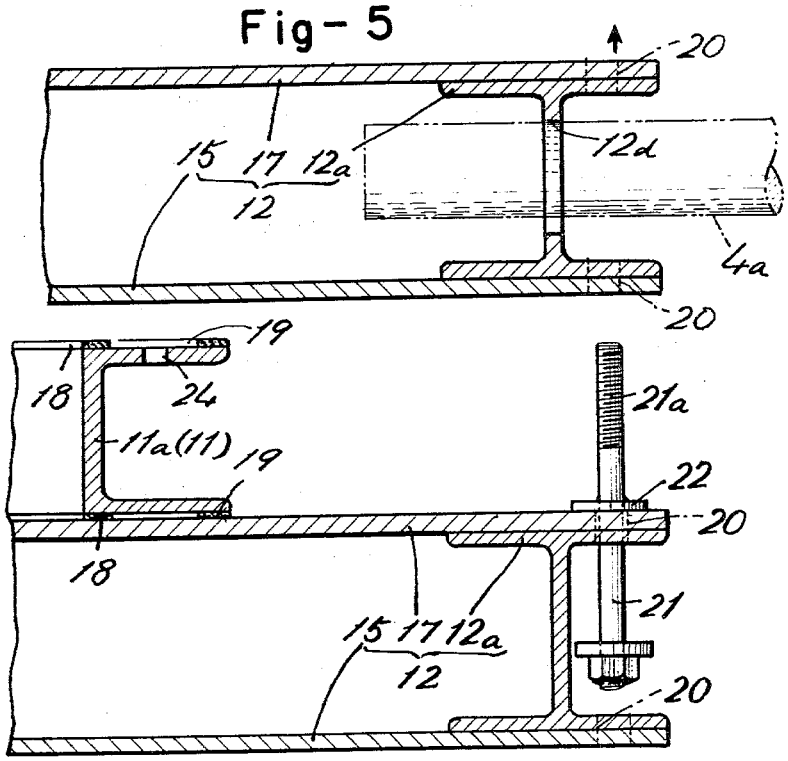
FIG. 5 is a sectional view showing various members shown in FIG. 4 before assembly.
Figure 8:
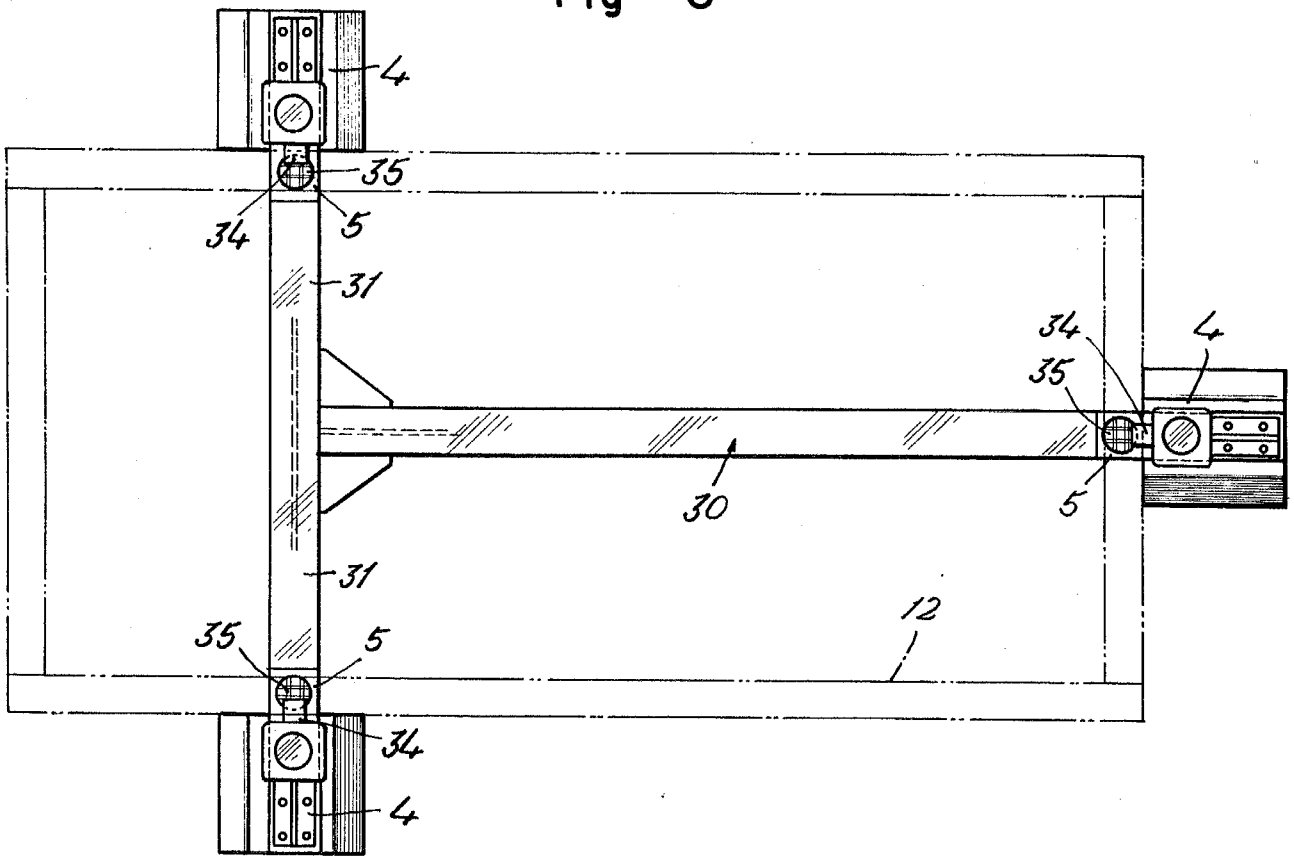
FIG. 8 is a plan view showing one example of a support utilized in this invention.
Figure 9:
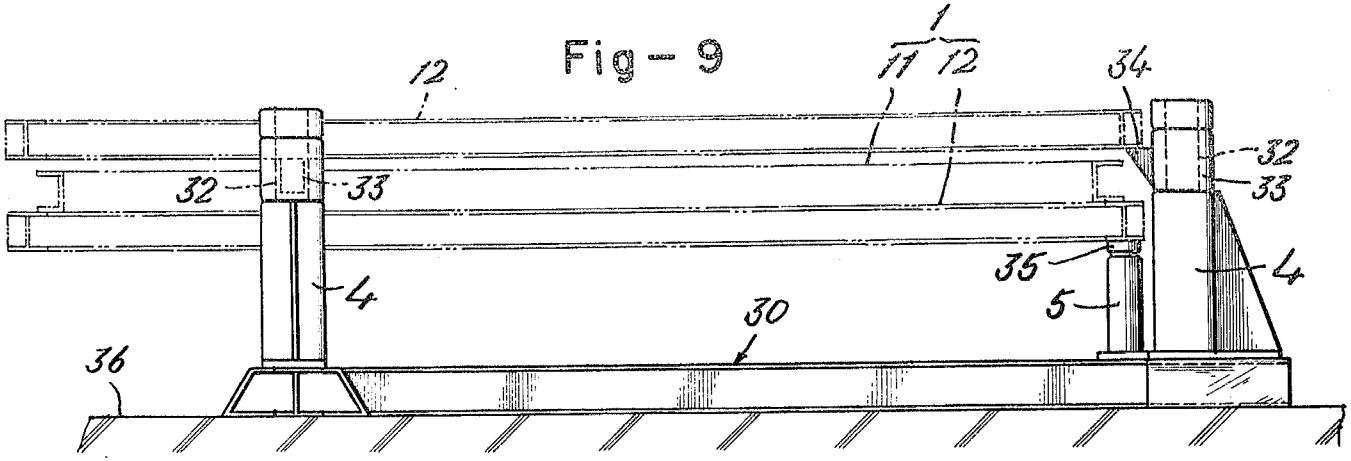
FIG. 9 is a side view of the support shown in FIG. 8.
Figure 10:
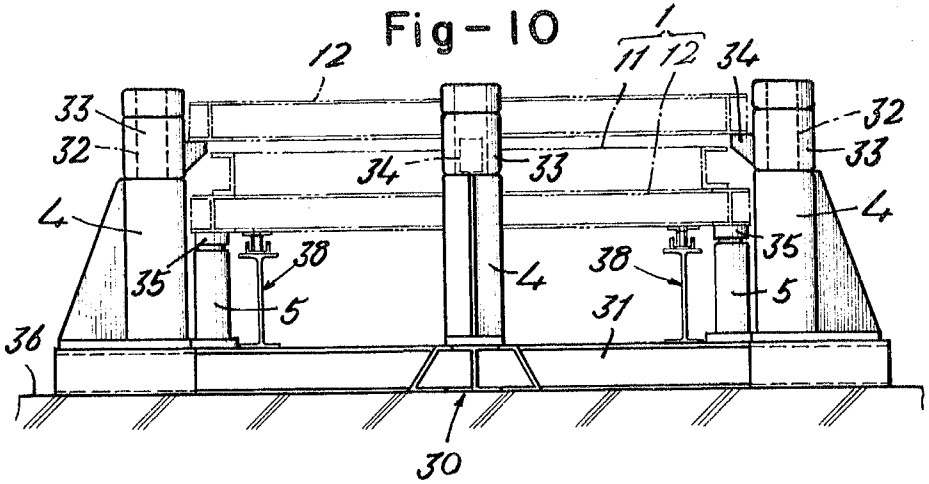
FIG. 10 shows a cross-section of the support shown in FIG. 8 taken along a line X—X.

Spacers 14 are interposed between adjacent moulds 1, a preferred spacer being shown in FIGS. 4 and 5. The supporting member 4*a* of the support 4 is received in a perforation 12*d* of the bed 12 of one mould 1. However, it should be understood that other supporting means can also be used. In the illustrated example, the supports 4 and the elevating means 5 are arranged such that, while the second mould 1 from bottom is being supported by the supports 4 the lowermost mould 1 is lowered onto the conveyor 3 by the elevating means 5. Alternatively, the lowermost mould 1 is elevated together with the mould thereabove by means of the elevating means 5 and then all moulds are supported by the supports 4 in their elevated position. Thereafter, another mould loaded with the hydraulic substance is slipped into the space beneath the lowermost mould. Then the uppermost mould containing a cured or releasable product is removed. One example of such alternative arrangement will be described later with reference to FIGS. 8, 9 and 10. In the example shown in FIG. 3, a new mould to be loaded with poured the hydraulic substance is added from above to the assembly. However, where it is advantageous to fabricate reinforcing steel bars in the moulds while they are maintained on the ground, the apparatus shown in FIGS. 8, 9 and 10 is preferred in which case the direction of movement of respective moulds is reversed from that shown by arrows in FIG. 3.

In the example shown in FIGS. 1 and 3 eight moulds 1 are piled up thereby greatly decreasing the required floor space when composed with the conventional flow system wherein the respective moulds are placed in a side by side relationship on the same plane. Even when large products having a surface area of several square meters are to be manufactured, the apparatus embodying the present invention requires a floor space of only about 20 square meters. Moreover as the moulds are arranged horizontally with their wide upper surfaces completely opened it is easy to place reinforcing steel bars or to mount fittings or the like in the moulds. Loading of the coarse aggregate and the hydraulic substance such as cement (a mixture of cement, a fine aggregate such as fine sand, fibers, metal wires, plastics, etc.) is also easy. The above described horizontal arrangement of the moulds wherein the moulds are held with their wider side surfaces completely opened is especially advantageous for producing products having light weights, high mechanical strength, excellent heat insulating property, heat preserving property, sound absorbing property or other desirable properties by placing at a definite and uniform spacing light weight, heat insulating, heat preserving or sound absorbing bodies which are shaped into desired configurations (polygon, sphere or cylinder, for example). These advantageous properties are obtained only when such bodies are loaded with a definite and uniform spacing in the mould. The arrangement of the moulds described above enables such uniform distribution.

The beds 12 including the bottom plates 15 completely close the upper and lower surfaces of the moulds when they are stacked on each other. Thus, when the hydraulic substance is poured into a given mould 1 by the loading mechanism 13 the bottom plate 15 of an upper mould acts as the cover plate for the given mould thus producing a moulded product having a smooth upper surface which does not require a later finishing operation. When supporting the bed 12 by the supporting members 4a it is advantageous to interpose a load carrying member 16 (FIG. 4) between the moulds and vertically above the supporting members 4a. With this arrangement the load of respective moulds is supported by the supporting members 4a of the supports thus relieving the moulded articles in respective moulds from the load applied thereto from upper moulds.

Preferably, the charging mechanism 13 comprises a closed tank and an opened tank and by reducing the pressure in the closed tank by means of a pressure reducing apparatus the hydraulic substance is poured into the moulds as will be described later.

The three point supporting system described above also relieves the mouled products in the moulds from the load applied thereto from above. Although four or more supporting points can also be used in this invention, such supporting system requires that the supports 4 and the elevating means should be extremely accurate and should operate uniformly. If there are difference between the heights of the supports and between the heights of the elevating means, the weight of the piled up moulds, which generally amounts to about 30 or more tons will be applied to the products thus fracturing or cracking the same. According to the three point supporting system of the present invention it is possible to stably support the moulds so that there is no fear of damaging the moulds and the products contained therein.

According to the present invention, for the purpose of facilitating charging of the hydraulic substance into closed moulds and improving the quality and mechanical strength of the products, suitable pressure reducing means is used. One example of the pressure reducing means illustrated in FIG. 3 comprises a pressure reducing means 45, such as a vacuum pump mounted on a supporting frame 44. The vacuum pump 45 is connected to the mould through an air-water separator 46, a valve 47 and a flexible horse 48 which is connected to a perforation 24 shown in FIGS. 4, 5 and 7 in a manner to be described later for subjecting the substance poured in the mould to a reduced pressure.

Further, in accordance with this invention, means is provided for accelerating the curing of the hydraulic substance poured into the mould. As is well known in the art, a hydraulic substance such as cement is cured or hardened by accelerating the hydration reaction of the substance. Such hydration reaction can be accelerated by heating. In the embodiment shown in FIG. 3 a distributor 58 connected to a source of heating medium such as a boiler (not shown) is mounted on the supporting frame 44 for directing the heating medium into the hollow beds of respective moulds 11 via a plurality of branch conduits 52. As shown in FIGS. 4 and 5 each bed 12 takes the form of a closed box so that the heating medium introduced into the bed heats the substance poured into the moulds from both sides. Accordingly, the hydration reaction of the hydraulic substance in the moulds is accelerated whereby the curing is completed in a short time thus producing hard or releasable products. As shown, the periphery of the bed projects laterally beyond the periphery of the mould so that the bed prevents the mould from being cooled by the ambient air with the result that the mould is uniformly heated. For this reason it is possible to efficiently cure the product without installing a special curing room. When the heating medium is introduced into the bed under a pressure, small openings, not shown, may be provided at suitable portions of the bed to decrease the pressure. Where the heating medium is steam, drain openings, not shown, for the condensate may be provided for the bed. The temperature and the temperature gradient of the heating medium suitable for use in this invention will be described later in connection with the preferred embodiment.

Figure 6:
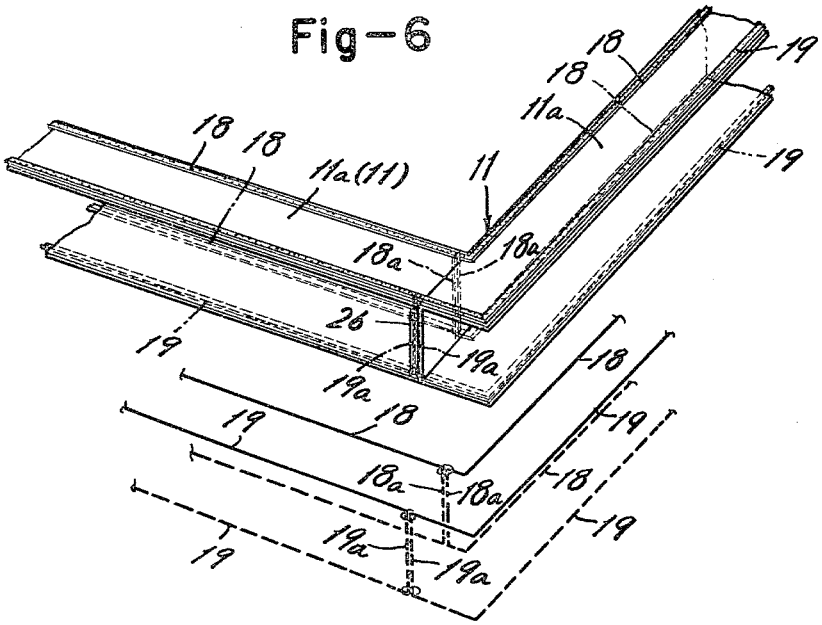
FIG. 6 is a partial perspective view showing the manner of mounting the sealing members.

One example of the preferred connecting means for interconnecting adjacent moulds and sealing member interposed between the beds and the moulds are illustrated in FIGS. 4 and 5, and the manner of mounting the sealing members upon the side frame is shown in FIG. 6. As has been pointed out hereinabove, the bed laterally projects beyond the periphery of the mould. As shown in FIGS. 4 and 5 each bed comprises I beams 12a on the periphery and a upper plate 17 and a bottom plate 15 which are secured to the upper and lower surfaces of the I beams 12a. The periphery of the mould is comprised by channel beam 11a. A paste or concrete sealing member 18 is mounted on the inner side of the channel beams 11a and an air sealing member 19 is mounted on the outer side of the channel beams on both sides thereof.

In the example shown in FIGS. 4 and 5, for the purpose of interconnecting adjacent moulds, perforations 20 are formed through the periphery of the bed 12 which projects beyond the periphery of the mould and through the upper and lower flanges of the I beam 12a for receiving a connecting member shown as a bolt 21. With this connecting means it is possible to readily add another mould, to the upper side or lower side to the assembly of the moulds. Further, it is possible to disconnect moulds containing cured products 100 from the upper or lower side of the assembly. To facilitate such operations a flange 22 is formed at an intermediate point of the bolt 21 and a nut 23 is screwed onto the threaded end 21a of the bolt 21. Thus, after inserting the bolt 21 through the perforation 20 of the upper plate 17 of a lower bed 12 until the flange 22 seats on the plate 17 the lower nut 21b screwed and fixed by spot welding as shown in FIG. 5, an upper bed 12 can readily be connected to the lower bed by inserting the upper portion of the bolt into the perforation 20 through the lower plate 15 of the upper bed and through the lower flange of the I beam 12a thereof and then tightening the nut 23. To remove the lowermost mould containing a cured product from the bottom of the stack of the the moulds shown in FIGS. 1 and 3, reverse operation is done. The lowermost mould disconnected in this manner is conveyed to the releasing station 100 by means of the conveyor 3.

The paste sealing members 18 may be made up metal because they are used for preventing paste from flowing outwardly of the mould whereas the air sealing members 19 are made of rubber or pliable synthetic resins so as to form air tight seals. The pressure in the spaces 25 between the shields 18 and 19 is reduced by connecting the spaces to the pressure reducing means 45 through openings 24 and flexible hoses, not shown. When the pressure in the spaces 25 is reduced in this manner, the paste sealing members 18 manifest but little resistance to the flow of air. Denoting the atmospheric pressure by P, the pressure in the spaces 25 by $P_1$, and the pressure in the mould by $P_2$, then a relation $P > P_1 > P_2$ holds. This equation shows that a reduced pressure is applied to the content of the mould. However, sine P1 and P2 are substantially equal, the content is subjected to the pressure of the pressure reducing means. Even when the air sealing means 19 contains some defects that leak air, as such air leaks into the space 25 which is constantly evacuated by the pressure reducing means 45, the pressure in the mould would not be affected by such leaking air. Thus, the spaces 25 function to act as cushions for the invading air, thus preventing it from increasing the pressure in the mould. With the novel sealing means, the paste such as cement in the mould contacts only with the paste sealing members 18 and not with soft air sealing members 19 so that these air sealing members 19 would not be damaged by the cement. Accordingly, after use of the mould, it is necessary to clean or repair only the paste sealing members 18.

FIG. 6 shows a manner of mounting the sealing members 18 and 19 onto the side frame 11 of a mould, particularly a corner thereof. More particularly, channel beams 11*a* are connected together as shown by solid lines in FIG. 6 to form the side frame 11. As shown, side plates 26 are secured to the abutting ends of one channel beams 11*a* which is faced to the back of another channel beams 11*a*, and the sealing members 18 and 19 applied to the upper surfaces of respective channel beams 11*a* are turned downwardly as shown by 18*a* and 19*a* at the joint and then applied onto the lower surfaces of the I beams 11*a* to form the lower sealing members 18 and 19 as shown by the dotted lines. In this manner, the lower and upper sealing members 18 and 19 are formed by continuous strips so that there will be formed no gaps or discontinuities thus providing effective sealing means all around the periphery of the side frame. When two I beams 11*a* are joined together, the sealing members 18 and 19 are also joined together at their depending portions 18*a* and 19*a*. Moreover, as such depending portions 18*a* and 19*a* are clamped between the abutting ends of the I beams, the joint is effectively sealed.

Figure 7:
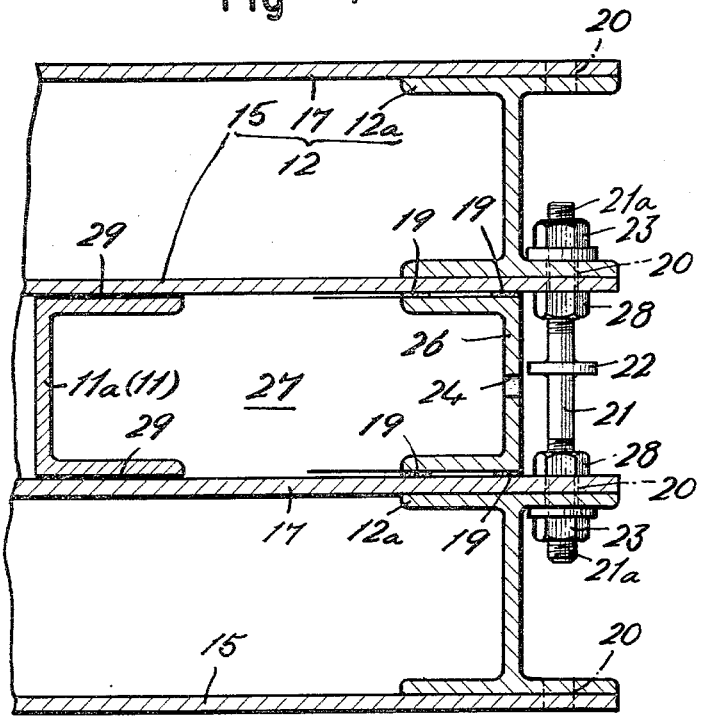
FIG. 7 is a partial sectional view showing a modified connecting member and sealing members.

FIG. 7 shows modified connecting means and sealing means. The construction of the connecting means and the sealing means shown in FIG. 7 is the same as that shown in FIGS. 4 and 5. The bolt 21 is provided with an intermediate flange 22 and threaded portions 21*a* on both ends. Nuts 23 and 28 are threaded on each threaded portion 21*a* for clamping the flanges of the I beams and the top and bottom plates 17 and 15 of adjacent beds 12. With this construction, the bolt 21 not only functions to interconnect adjacent beds 12 on the opposite sides of the side frame 11 of one mould but also functions as the load carrying member 16 shown in FIG. 3. Further, in this modification, no particular sealing member is provided for the side frame 11 and the upper and lower surface 29 of the side frame 11 are maintained in metal-to-metal contact with the bottom plate 15 and the upper plate 17 of the adjacent beds 12 when the nuts 23 are tightened, thus providing paste sealing members. An auxiliary channel I beam 26 is interposed between the bottom plate 15 and the upper plate 17 in vertical alignment with the I beams and air sealing members 19 respectively between the upper and lower surfaces of the auxiliary channel beam 26 and plates 15 and 17 of the adjacent beds. The space 27 defined by two channel beams 11 and 26 and plates 15 and 17 corresponds to the space 25 shown in FIG. 4 and a perforation 24 is formed through the channel member 26 for the purpose of communicating the space 27 with a pressure reducing means not shown. With this modified construction, as the volume of the space 27 is large the paste sealing members 29 and the air sealing members 19 are remotely spaced from each other so that there is no fear of contaminating the air sealing members 19 with paste or cement. Moreover, it is possible to readily handle the mould in the same manner as in the previous embodiment.

FIGS. 8, 9 and 10 show a different arrangement of the supports 4 and elevating means 5 suitable for continuously treating the moulds. In this embodiment also the supports 4 and the elevating means 5 are arranged to constitute three point supports, as in the embodiment shown in FIGS. 1 and 2. The moulds shown in FIGS. 8 to 10 are constructed as to be transportable. Thus, bars 30 and 31 are connected together to form a T shaped base and sets of support 4 and elevating means 5 are provided for the opposite ends of bar 31 and the right-hand end of bar 30. When such base incorporated with three sets of the support and elevating means is installed on the ground 36, desired moulding operation can be commenced at once. The assembly can be moved to any desired place. Different from the embodiment shown in FIGS. 1 to 3, in the modification shown in FIGS. 8 to 10, while a mould 1 is held on the ground 36, reinforcing steel bars, aggregate, fittings etc. are fabricated in the mould and then the hydraulic substance is poured into the mould. Then the filled mould is added to the bottom of a stack of filled moulds to be subjected to the required treatments described above. The mould containing a cured or releasable product is removed from the upper side of the stack. For this purpose, a shaft 32 is mounted on each support 4 for carrying a rotatable member 33 provided with a supporting ledge 34. An elevating means 5 provided with a head 35 is positioned on the inner side of each support 4.

The embodiment shown in FIGS. 8 to 10 operates as follows. A mould 1 charged with the hydraulic substance is brought beneath the stack of moulds (only the bed 12 of the lowermost mould is shown) which are supported by the supports 4 by means of a conveyor 38, as shown in FIG. 10. The mould is then elevated by the elevating means 5 until the upper surface of the side frame 11 of the mould is caused to abut against the lower surface of the bottom plate of the lowermost bed 12 of the assembly thus sealing the mould. As the newly added mould 1 is elevated further by the elevating means 5, the assembly of the moulds is also elevated with the result that the lowermost bed 12 disengages from the supporting ledges 34. Then the rotatable members 33 are rotated to displace the ledges from under the stacked assembly. When the lower surface of the bed 12 of the newly added mould is elevated to the level of the uppersurface of the supporting ledges 34, the ledges 34 are rotated back to the positions shown in FIG. 10 whereby the newly added mould is incorporated into the assembly. At this time, the newly added mould is connected to the bottom of the assembly by suitable connecting means such as the bolts 21 described above. Then the heads 35 of the elevating means 5 are lowered to receive the next mould. In this case a crane (not shown) may be used to remove the uppermost mould containing a cured product from the top of the assembly.

Figure 11:
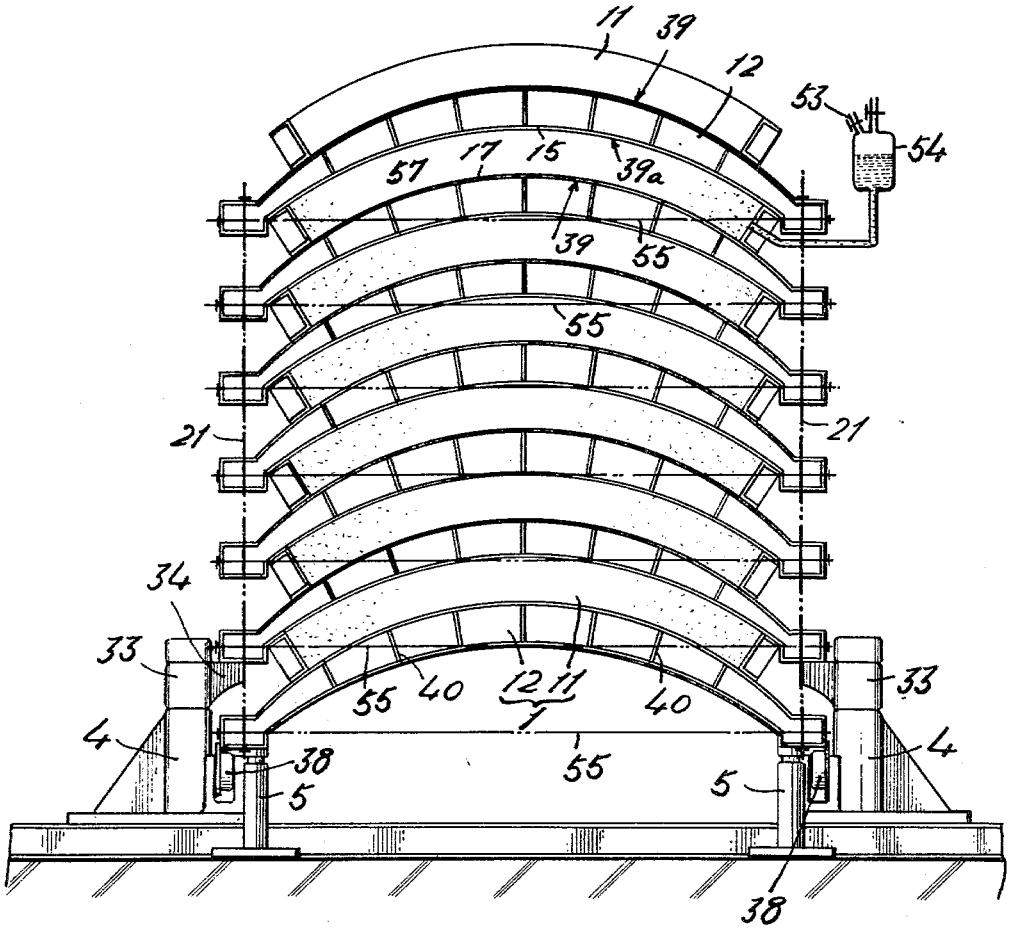
FIG. 11 is a side view of the novel apparatus of this invention utilized to manufacture arcuate segments.

In the embodiments shown in FIGS. 1 to 3 and FIGS. 8 to 10, the moulds are flat and horizontal but the present invention is not limited to the moulds of such particular configuration. In the embodiment shown in FIG. 11 the side frame 11 of the moulds have accurate cross-sectional configuration which are supported by the supports 4 and elevating means 5 having the same construction as those shown in FIGS. 8 to 10. In this case, each bed 12 is provided with upper plate 17 and bottom plate 15 having curved surfaces 39 and 39*a* of the radius of curvatures commensurate with those of the inner and outer surfaces of the products. Suitable reinforcing members 40 are provided between the upper and bottom plates 39 and 39*a* of each bed. Where the upper plate 17 and the bottom plate 15 of adjacent beds 12 are arcuate as shown in FIG. 11, even when a hydraulic substance is moulded in a moulding chamber 57 defined between these plates under a considerably high pressure, these plates will not be deformed. Especially when the opposite ends of the beds 12 interleaved with the moulds are connected together by means of bolts 21 or the like the plates 15 and 17 can resist against considerably high internal pressure without deformation. As a consequence, where a source of pressure such as a compressor, not shown, is connected to the loading mechanism 54 for loading flowable hydraulic substance into the moulds through a fitting 53, it is possible to apply a considerably high pressure of the order ot 5 to 8 $Kg/cm^2$ upon the hydraulic substance poured into the moulds thus increasing the density of the products.

It should be understood that the apparatus of this invention is not limited to those described above and that various modifications are possible without departing from the spirit of the invention. For example, instead of using two types of sealing members, that is the air sealing member and the paste sealing member, it is possible to use a single sealing member for sealing against air and paste. Although the connecting members shown in FIGS. 4, 5 and 7 are suitable for adding a new mould to one side of the stack of moulds and for removing a mould containing a cured product from the other side of the stack other connecting means can also be used. For example, a plurality of perforations may be formed through respective side frames, and a plurality of moulds may be connected together by means of long bolts which are staggered with one mould height in the vertical direction. When it is desired to add a new mould or to remove a mould containing a cured or releasable product from the stack one of the bolts is removed. More particularly, when one of the bolts is positioned to project from one side of the stack for making it possible to add the new mould to this side, the mould containing a releasable product can be removed from the other side of the stack.

Figure 12:
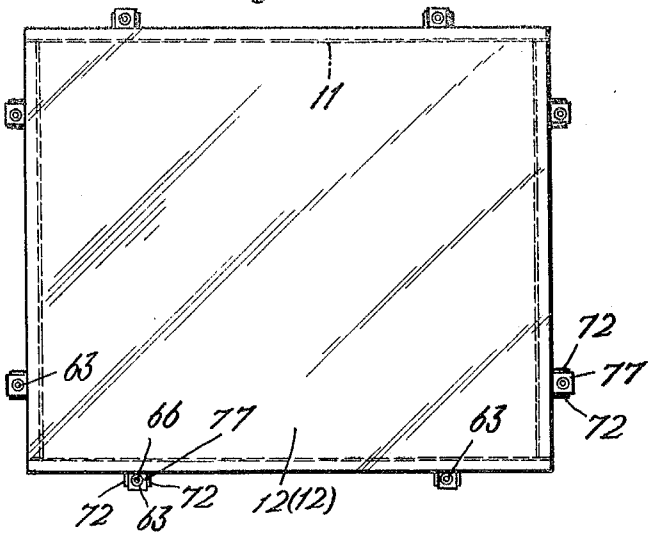
FIG. 12 shows a plan view of a bed utilizing modified connecting means for interconnecting adjacent beds.
Figure 13:
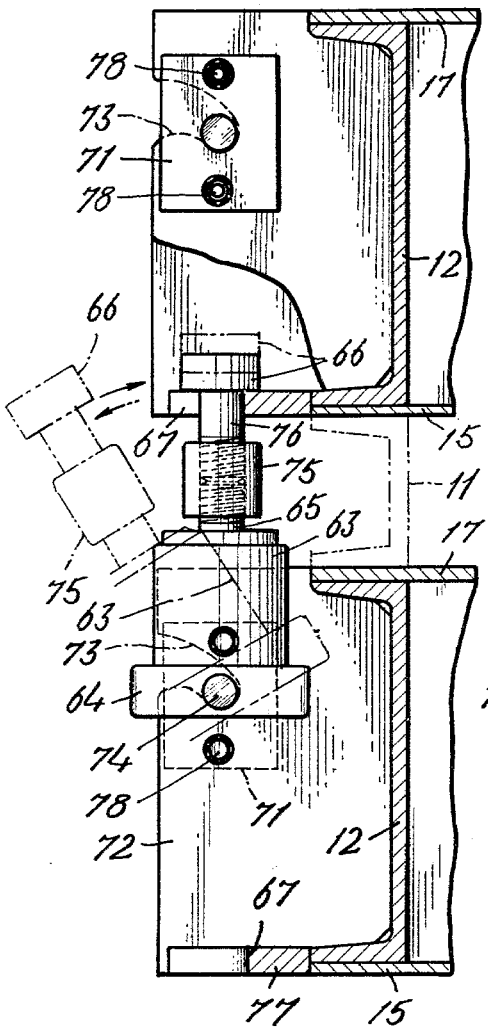
FIG. 13 is an enlarged sectional view taken along a line XIII—XIII shown in FIG. 12.
Figure 14:
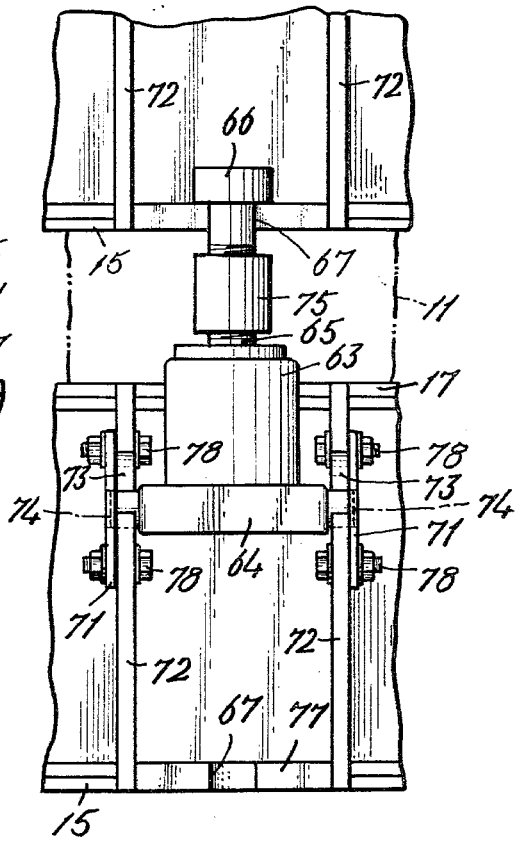
FIG. 14 is a side view, partly broken away, of the assembly shown in FIG. 13 as viewed from the lefthand side.

FIGS. 12, 13 and 14 show another embodiment in which the side frame comprising a closed mould is constructed to be readily clamped and released.

In the manufacture of various products from a hydraulic substance such as cement it is necessary to assemble and disassemble the moulds. Moreover, where a plurality of moulds are stacked as has been described in connection with FIGS. 1 through 11, adjacent moulds are connected together by means of a plurality of bolts and nuts. The use of plurality of bolts and nuts requires a large amount of labor and time and all nuts are not always tightened uniformly with the result that a considerable stress will be created in the product due to unequal expansion thereof when it is heat cured, such unequal expansion making it difficult to loosen the nuts.

The embodiment shown in FIGS. 12, 13 and 14 was developed for eliminating such defects. In this embodiment, box shaped beds 12 are disposed on both sides of each side frame 11 and an adjustable operating cylinders 63 are pivotably mounted on one bed by means of pivot pins 74 secured to the bases of the operating cylinders. The piston rod 65 of each operating cylinder 63 is connected to a piston rod 76 including a locking head 66 through a turn buckle coupling 75 which is used to adjust the height of the head 66. An anchor plate 77 provided with a notch 67 for receiving the piston rod 76 is secured to the bottom of the other bed 12. By tilting the operating cylinder 63 to the position shown by dot and dash lines in FIG. 13, the head 66 is disengaged from the anchor plate 77. The operating cylinder 63 cn be mounted in position by fitting its pivot pins 74 in curved slots 73 in two side plates 62 and then by fastening supporting plates 71 secured to the pins 74 to the side plates 72 by bolts 78. For the purpose of interconnecting a plurality of side frames 11 of the moulds into a stack, the slots 73 are formed near the upper side of the beds and the anchor plates 77 are welded to the bottom of the beds as shown in FIG. 13. Although not shown in the drawing, suitable pipes may be connected to the beds 12 for introducing into the box shaped beds 12 heating medium, steam for example, for heating and curing the hydraulic substance poured into the mould. A plurality of operating cylinders 63 mounted around the periphery of the beds are operated by fluid under pressure like conventional pneumatic or oil pressure cylinders.

After causing the heads 66 to engage the anchor plates 77 the cylinders 63 are operated to pull down the heads 66 against the anchor plates 77. With this arrangement it is possible to simultaneously operate all cylinders by manipulating a single control valve common to all cylinders. Further it is possible to apply the same or substantially the same clamping force to all clamping heads. The clamping force of each head can be independently adjusted during curing by turning the turn buckle coupling 75.

In this embodiment, as the operating cylinder 63 is mounted in position by means of the supporting plates 71, any defective cylinder can be readily removed by dismounting the supporting plates 71. The use of the turn buckle coupling 75 permits not only the adjustment of the height of the locking head 66 but also the exchange of the locking head. Accordingly, it is possible to use the same operating cylinder for side frames having different height by adjusting the height of the locking head 66 or by exchanging the heads.

Figure 15:
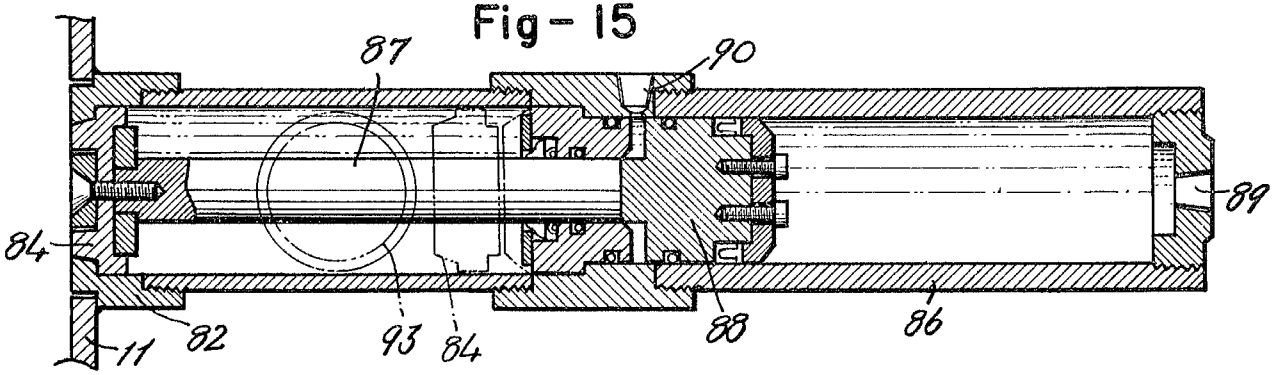
FIG. 15 is a longitudinal sectional view of a pouring device of the hydraulic substance provided with cleaning means.
Figure 16:
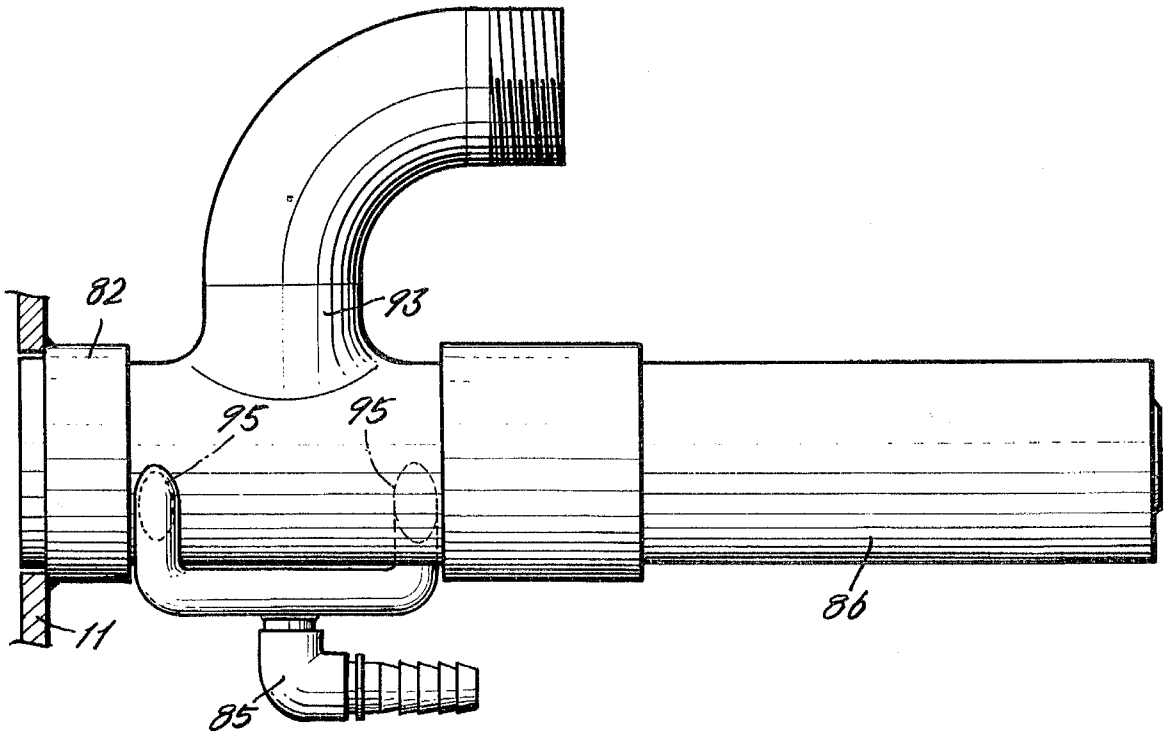
FIG. 16 is a plan view of the pouring device shown in FIG. 15.

FIGS. 15 and 16 show a mould utilizing a novel pouring means for pouring the hydraulic substance into the mould which is constructed to close the pouring port after completion of the pouring operation and to facilitate cleaning the pouring pipe for enabling repeated use thereof.

The hydraulic substance is generally poured into the mould under pressure or suction. However, unless providing suitable means the hydraulic substance poured into the mould often flows back into the pouring tube. Especially, when concrete or mortar is cast, the concrete or mortar flowed back into the pouring tube solidifies and clogs the same. Even when a check valve is connected in the pouring tube for the purposes of preventing such back flow, the check valve itself would be rendered inoperative by the solidification of the cement adhering thereto. Although it is possible to complete the moulding by remaining the pouring conditions of the hydraulic substance while in this case the hydraulic substance remaining in the pouring tube and cured by the hydration reaction. Thus the substance will solidify in the pouring tube more quickly than in the mould. This requires frequent renewal of the pouring tube or at least to decompose and clean the same, thus greatly decreasing the efficiency of operation.

The pouring means shown in FIGS. 15 and 16 is constructed to obviate these difficulties. More particularly, a pouring tube 83 is connected to a side frame 11 of a mould through a fitting 82. As shown in FIG. 16, the pouring tube 83 takes the form of a letter T and a conduit 93 opening into an intermediate point of the tube 83 is connected to a pouring tank, not shown, for pouring the hydraulic substance into the mould under pressure or static head. A piston 84 is mounted on a piston rod 87 to be slidable in the pouring tube 83. A pipe 85 for admitting cleaning water into the pouring tube 83 is provided and its bifurcated inlet tubes 95 open into the pouring pipe 83 on both sides of the conduit 93 and on the opposite sides of the pouring tube 83 as shown in FIG. 16. The piston 84 is operated by fluid pressure. To this end, an operating cylinder 86 is connected to one end of the pouring tube 83 and a piston 88 contained in the operating cylinder 86 is connected to the righthand end of the piston rod 87 carrying the piston 84 for moving the same between the solid line position and the phantom line position. Instead of providing the operating cylinder 86, it is also possible to operate the piston 84 by means of a manually operated screw mechanism, not shown. Operating fluid is supplied into and exhausted from the cylinder 86 via ports 89 and 90. Thus, the pistons 84 and 88 are advanced by introducing the operating fluid through port 89 and discharging it through port 90 and vice versa. When the piston 84 is retracted to the phantom position, the hydraulic substance supplied through the conduit 93 can be poured into the mold. As the piston 84 is moved forward by piston 88, the inside of the pouring piston 83 is cleaned. Furthermore when the piston 84 is moved to the solid line position shown in FIG. 15, the inlet port 82 of the side frame 11 of the mould is closed thus terminating the pouring operation. Under these conditions water or other cleaning liquid is introduced into the pouring tube 83 from pipe 85 to remove the hydraulic substance remaining in the pouring tube 83 and the conduit 93. Such cleaning device can be removed from one mould to the other thus saving the labor required for cleaning.

Figure 17:
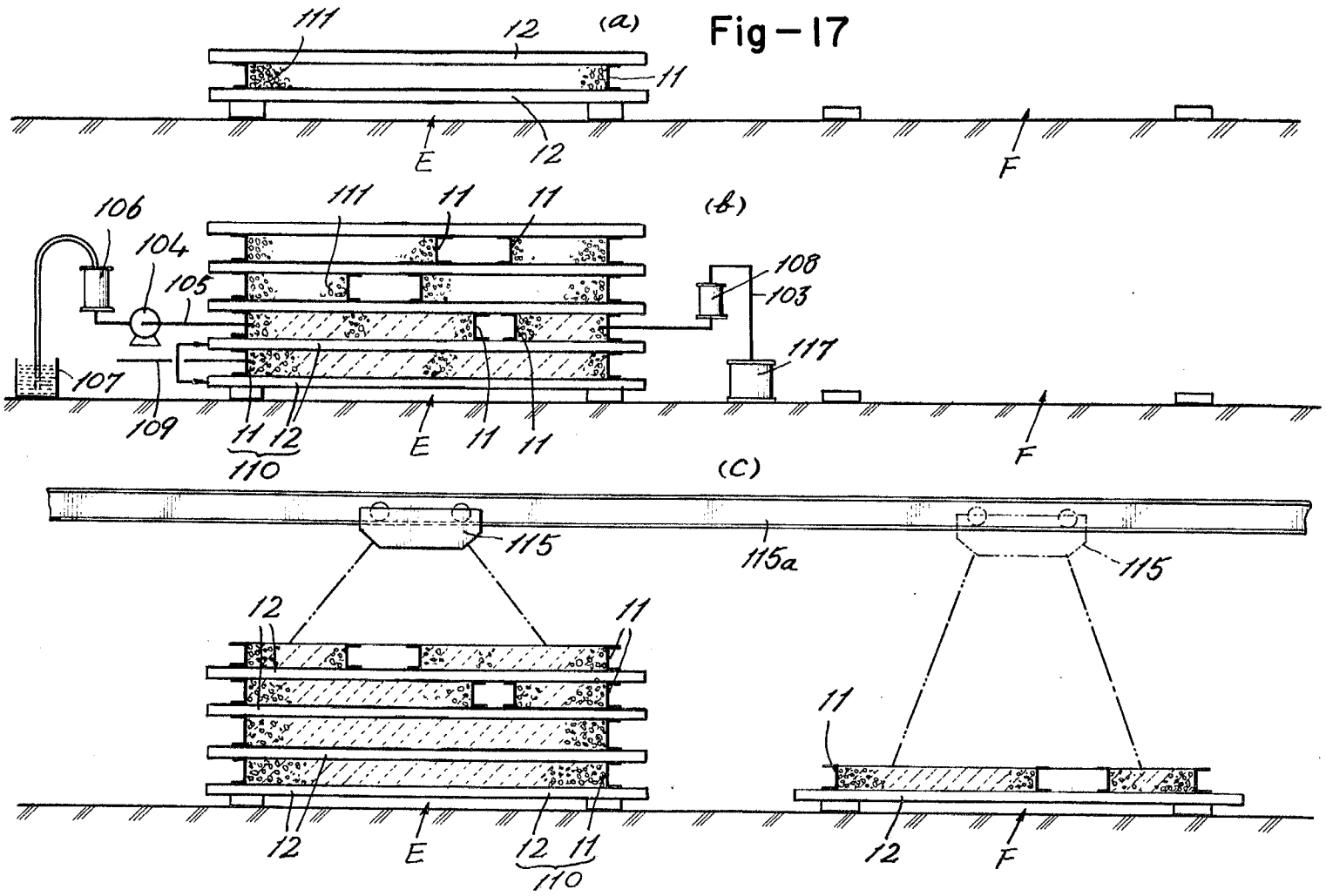
FIGS. 17*a*, 17*b* and 17*c* are diagrammatic side views showing a manner of fabricating the stack of the moulds alternately in one and other stations in the field.
Figure 18:
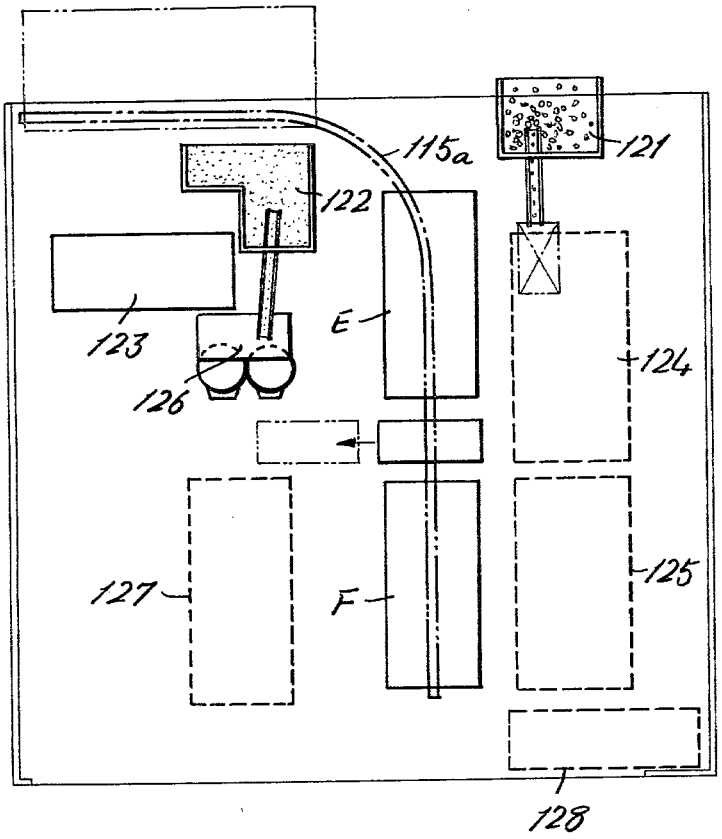
FIG. 18 is a plan view of the field showing an arrangement of the fabricating stations and yards for collecting various raw materials, a boiler, a pressure reducing means, etc.

FIGS. 17 and 18 show a method and apparatus suitable for manufacturing various component parts by a batch process in a field of constructing buildings.

The size and configuration of the component parts required for fabricating buildings varies considerably.

In skyscrapers, component parts for the same portions of different floors have different configuration and size. Where such component parts are mass produced in a factory and transported to the field of construction, it is not only troublesome but also is accompanied by the danger of damaging the component parts during transportion because of their large weight and size.

Further, the articles of concrete or other hydraulic substances are prepared by pouring the hydraulic substance in a mould. However, in order to obtain dense product it is necessary to vibrate the mould after it has been filled with the hydralic substance. To set the mould to withstand against the applied vibration it has been the practice to fix the mould to a bed by means of bolts or other fixing means. Where a variety of products are to be produced it is necessary to prepare a number of beds corresponding to the types of the products or moulds thus reducing productivity. More particularly, the factory is required to prepare many types of moulds and beds.

The present invention contemplates elimination of such defects of the prior art method by sequentially manufacturing the component parts in the field of fabrication thereby enabling smooth fabrication of the building according to a prescribed schedule. This improved method eliminates the construction of a particular factory, and makes it possible to transport the coarse aggregate, sand, cement and other raw materials directly to the field of construction. Accordingly, it becomes unnecessary to transport products of large weight and variety to the field of construction from the factory. Vibration of the mould which has been imparted to the moulds for compacting the products accompanies noise. But when the hydraulic substance is poured into the mould by reducing the pressure therein it is not necessary to vibrate the mould. Accordingly, the problem of noise does not occur.

Although the apparatus shown in FIGS. 1 through 11 are suitable for continuous production, they are bulky and accompany certain inconvenience in operation. The apparatus shown in FIGS. 17 and 18 has been simplified for a batch system, which is constructed to construct the component parts for the third and higher floors of the buildings, and to be installed in the building. More particularly, up to the second floors, the building is fabricated according to the prior method and then the apparatus shown in FIGS. 17 and 18 is used. Then the workmen can use the portion of the building which has been fabricated as above described as the scaffolding for the assembly of a plurality of moulds and beds. Instead of utilizing the prefabricated portion of the building the apparatus shown in FIGS. 17 and 18 can also be installed in a relatively narrow site adjacent the building under construction. As shown in FIGS. 17 and 18, two areas or stations E and F are selected for assembling the mould into a stack and areas or yards 121, 122, 123 for collecting the coarse aggregate, fine aggregate and cement, respectively, an area 124 for working reinforcing steel bars, a stockyard of the reinforcing steel bars, a mortar mixer 126, a vacuum pump and a vacuum tank 127 and a boiler room 128 are located about the areas E and F. The coarse aggregate, the fine aggregate and cement are transported to their respective yards 121, 122 and 123 by trucks or the like. The steel bars collected in the stockyard 125 are suitably worked in the area 124. The worked reinforcing steel bars are disposed in a side frame 11 of the mould located in the first area A, and then the coarse aggregate 111 is packed in the mould as shown in FIG. 17*a*. A box shaped bed 12 provided with a bottom plate is mounted on the mould with an inside mortar sealing member and an outside air sealing member, not shown, interposed therebetween. The mould is sealed from the atmosphere by clamping it between two beds. A plurality of beds and moulds are stacked to form an assembly 110 as shown in FIG. 17*b*. Depending upon the size of the product a plurality of moulds can be interposed between two beds as shown by the uppermost stage of the assembly shown in FIG. 17*b*. The moulds of the assembly are then connected to the vacuum tank 127 through a conduit 103 to reduce the pressure in the moulds to about 0.1 $Kg/cm^2$. When the pressure in the mould is reduced, the beds are urged against the mould by the atmospheric pressure thus effectively sealing the mould. Then the mortar is poured into the mould under the reduced pressure condition. While conduit 103 leading to the vacuum tank 127 is connected to the mould through an overflow tank 108, the mortar prepared by a mixer 126 is put into an open tank 107 and then poured into the mould through a closed pouring tank 106, a mortar pump 104 and a pouring pipe 105 which is connected to the side of the mould opposite to the conduit 103. In the state shown in FIG. 17*b*, the lowermost mould has already been poured with mortar and the mould second from the bottom of the stack is under pouring. Thus, after connecting the pouring pipe 105 to this mould, as the valve, not shown, in the pouring tube 105 is opened the mortar can be poured into the mould which is maintained at a reduced pressure by the pouring pump 104. Although not shown in the drawing the pressure in the closed pouring tank 106 is reduced by a suitable pressure reducing means so that the entrained air and excessive moisture are removed from the mortar. Thereafter the mortar is poured into the interstices of the coarse aggregate and into the structure thereof from which air has already been removed by the vacuum tank 122, thereby producing a dense product as in the previous embodiments. Steam is admitted from boiler 128 into the beds 12 on the opposite sides of a mould poured with the mortar to heat and cure the mortar product. Generally, the heat curing is performed at a temperature of from 60 to 85° C. for accelerating the hydration reaction of the poured mortar thereby improving its compression strength in a short time.

Accordingly, it is easy to produce mortar products having a compression strength of more than 180 $Kg/cm^2$ by proper curing operation. Such products are suitable to use as wall panels, floor panels, etc. of buildings immediately after they have been removed from the moulds. FIG. 17*b* shows one arrangement of releasing the products from the moulds. Thus, the release can be effected by utilizing an overhead crane 115 running along a rail 115*a* mounted on a ceiling of a partially fabricated building. The beds 12 and the side frames 11 disassembled in the first area E are transferred to the second area F after cleaning or application of a mould release. In area F different moulds may be used according to the progress of constructing the building. The same pouring and curing operations as in area A are also performed in area F. Although in area F, the order of stacking the beds and side frames is opposite to that in area A, the same pouring and curing operations are performed.

Figure 19:
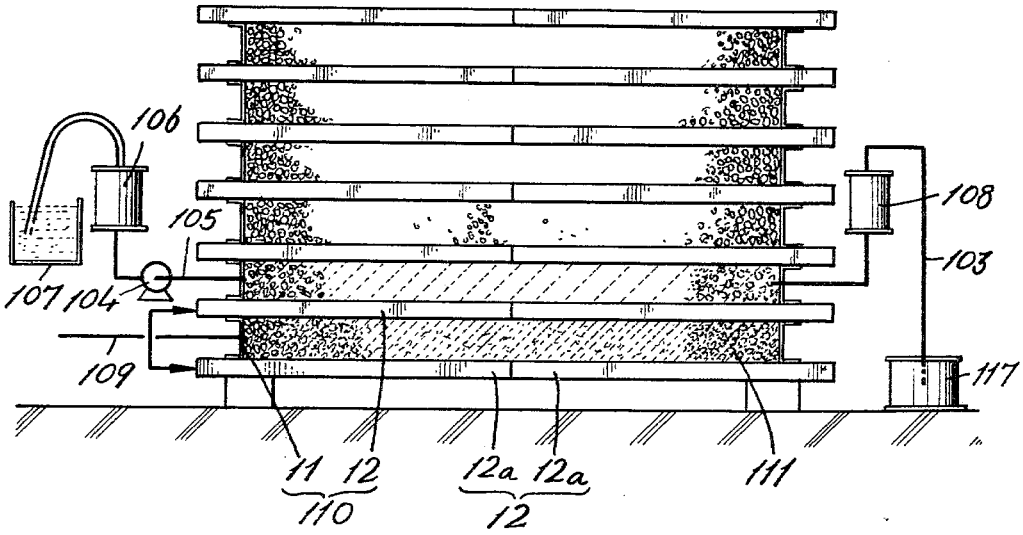
FIG. 19 is a side view of a stack of a plurality of moulds wherein each bed is composed by two bed units.
Figure 20:
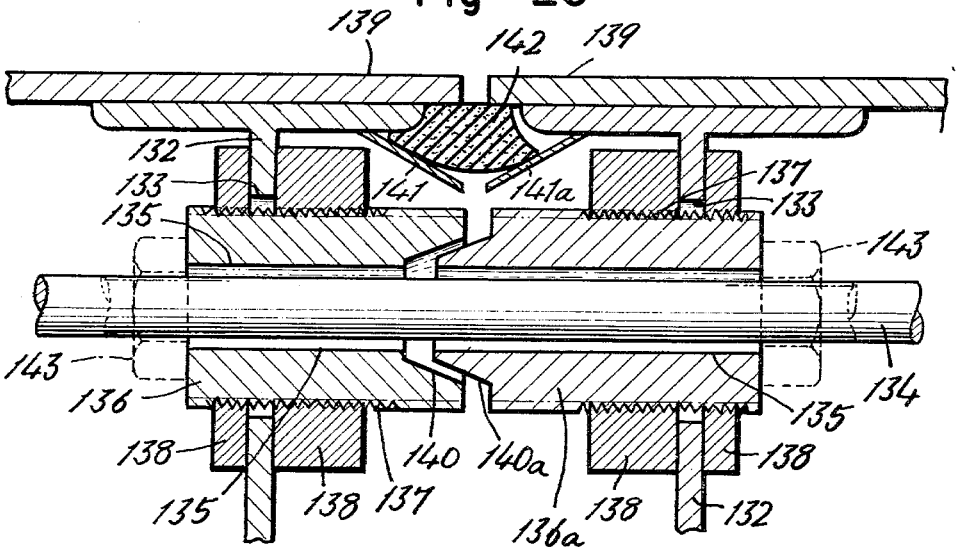
FIG. 20 is an enlarged sectional view of the joined ends of two bed units.
Figure 21:
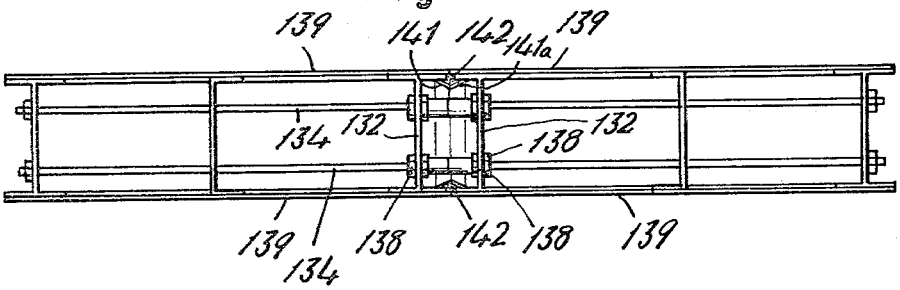
FIG. 21 is a diagrammatic sectional view showing the position of reinforcing flanges and FIG. 22 is an enlarged sectional view showing a modified sealing member interposed between two bed units.

FIGS. 19, 20 and 21 illustrate a preferred construction of the beds which are used in the arrangement shown in FIGS. 17 and 18. While the moulds are constructed to be able to be disassembled, it is advantageous that the beds are of the unitary construction. However, it is difficult to convey large beds to the field of constructing buildings in view of the capacity of trucks utilized to transport the beds.

For this reason, the bed shown in FIGS. 19, 20 and 21 is divided into a plurality of units which are assembled into a single flat bed, suitable for use in carrying out the method of this invention. FIG. 19 shows a side view of a stack comprising a plurality of beds and side frames 11 of the moulds and fabricated in either one of the areas E and F shown in FIG. 17. Each bed comprises two identical bed units 12*a*. Except for the divided beds, the stack shown in FIG. 19 is identical to that shown in FIG. 17*b*.

FIG. 20 shows the joint between two bed units 12*a*. Thus, a reinforcing flange 132 is secured to the lower side of each unit near its end. The reinforcing flange 132 is provided with an opening 133 for loosely receiving a connecting member, for example a steel rod 134 and positioning members 136 and 136*a*, respectively, provided with openings 135*a* are mounted on the connecting member 134. Screw threads 137 are formed on the peripheries of the positioning members 136 and 136*a* to receive nuts 138 and 138*a* located on the opposite sides of the reinforcing flange 132. To compensate for the manufacturing error of the bed the positioning members 136 and 136*a* are brought into axial alignment by adjusting the nuts 138 and 138*a* so as to make flush the upper surfaces 139 of the bed units. Furthermore, the positioning members 136 and 136*a* are formed with members provided with mating inclined surfaces 140 and 140*a* for assuring the flush relationship of the upper surfaces 139. Further, beneath one end of one bed unit is provided an air sealing member 142 which is held in position by a holding member 137. When two bed units are joined together, the other end of the air sealing member 142 is received by holding member 141 secured to the end of the other bed unit thus sealing the interior of the bed against atmosphere.

FIG. 20 shows an enlarged sectional view of the upper sides of two bed units 2*a* which are connected together and it is understood that the lower sides are constructed similarly. In this manner, when bonded together the two bed units form an integral bed having substantially flat upper and lower surfaces which are used as the moulding surfaces wherein the bed units are air tightly joined together.

In the example shown in FIG. 20, the connecting member 134 is shown as a long rod extending to the opposite sides of the assembled bed. However, where the length of the bed is long, for example several meters or more, the connection of two bed units is not sufficiently rigid due to the elongation of long connecting members 134. In such a case some of the connecting members may be made short and nuts 143 (shown by dotted lines) may be threaded on the connecting members 134 for interconnecting the positioning members 136 and 136*a*. The use of such short connecting members eliminates the above described trouble caused by the elongation thereof thereby providing a firm bonding. By using both short and long connecting members, a firm joint can be formed. To turn the nut 143 mating a short connecting member, the bed surface 137 is provided with an opening (not shown) which is normally closed by a cover plate with a sealing member (not shown). The long and short connecting members can be disposed alternately or at different levels.

Figure 22:
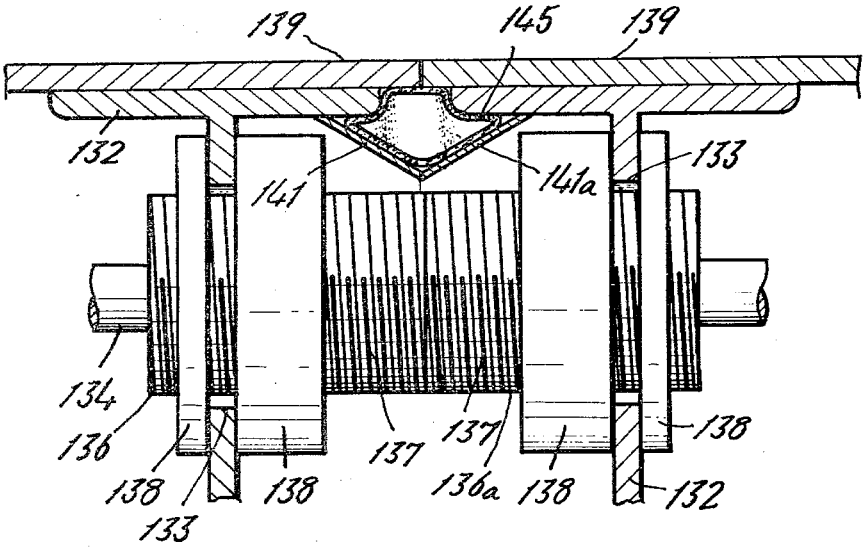

A hollow tubular air sealing member 145 may be used at the joint between two bed units as shown in FIG. 22. Such sealing member 145 is disposed between holding members 141 and 141*a* in a deflated condition and then inflated by air. Such tubular air seal member 145 is advantageous because it can be readily exchanged and establishes a good air seal when inflated.

As described above, since the bed units are provided with positioning members 136 and 136*a* at their ends to be joined together, after disassembly and transportion to any desired field of constructing buildings it is possible to fabricate the bed units into an integral flat bed by using the connecting members. Moreover, the interior of the assembled bed is efficiently sealed by the sealing member so that the bed can be used to mould the hydraulic substances under reduced pressures. To have a better understanding of the present invention the following examples are given.

EXAMPLE 1

In this example, the apparatus shown in FIGS. 1 through 5 was used. Each side frame 11 of the mould had inner dimensions of 2.4×5.2 m and a height of 150 mm. In the uppermost mould was poured concrete containing 305 Kg of cement per cubic meter of concrete and an excess quantity of mortar was added to the center of the upper surface of the cement poured into the side frame 11. The poured side frame was shifted downwardly and a bed 12 was mounted on the side frame and connected thereto by bolts 21. Heating steam was introduced into the beds associated with lower moulds through distributor 58 for curing the concrete. The temperature and the pressure in the moulds were measured at intervals. At first the temperature and pressure were normal but increased to 30° C. and 0.2 Kg/cm$^2$ after 30 minutes, 60° C. and 0.5 Kg/cm$^2$ after 60 minutes, 75° C. and 0.7 Kg/cm$^2$ after 90 minutes and 102° C. after 120 minutes. These temperature and pressure were maintained during an interval of from 120 to 150 minutes. Thereafter cooling was commenced. Thus, the steam which has been introduced into the beds 12 was switched to cooling air after 180 minutes. At about 210 minutes when the temperature has decreased to 70° C., the air was switched to cooling water having a temperature of about 40° C. The temperature of the cooling water was decreased gradually. When the temperature of the product in the lowermost mould has decreased to 40° C. at 240 minutes, the lowermost mould was separated from the stack and transferred to the releasing station 100 by means of the conveyor 3.

Immediately after releasing from the mould, the product had a compression strength of 125 Kg/cm$^2$ which was increased to 175 Kg/cm$^2$ after one week and to 305 Kg/cm$^2$ after 4 weeks. The dimensional accuracy of the product was also excellent. Although some air voids remained on the surface of the product, the product is suitable for use as an outside wall of various buildings.

EXAMPLE 2

Apparatus and mould frames identical to those used in Example 1 were used for manufacturing floor plates. After fabricating reinforcing steel bars and fittings used for interconnecting adjacent plates in respective moulds according to prescribed design, concrete was poured and cured according to the same process steps as in Example 1. In this Example for the purpose of eliminating air voids remaining on the surface of the products of Example 1, a plurality of small openings having a diameter of 1 mm were formed through the bottom plate 15 of the bed overlying the side frame 11 and after levelling the upper surface of the concrete poured in the mould, the upper surface of the concrete was covered by a sheet of cloth with its periphery extended to the paste sealing members 18. Then, the bed was placed on the mould with its bottom plate 15 contacted with the cloth. Thereafter, adjacent beds were interconnected by bolts 21. Heat curing was performed in the same manner as in Example 1 and the pressure created in the mould by this heating was effective to drive air entrained in the cast concrete and excessive moisture to the outside of the paste sealing members 18 through said sheet of cloth and small openings. After treatment for 240 minutes, the lowermost mould was transferred to the releasing station 3. Immediately after releasing from the mould the product showed a compression strength of 128 Kg/cm$^2$ which was increased to 179 Kg/cm$^2$ after one week. There was no air void remaining on the surface of the product and the dimensional accuracy of the surface was ±1.5 mm thus requiring no surface finishing. Thus it was possible to obtain a product having a flat surface by merely applying a coat of paint.

The number of workmen required for fabricating the reinforcing stell bars and fittings were 3 and the number of workmen required for performing the entire process, including the treatment of the side frame after releasing the products, was 7. It is possible to produce 16 floor plates per day each having a dimension of 2.4×5.2 m by two cycles of 8 working hours. According to the prior art method and apparatus it was possible to produce the same number of floor plates with 16 workmen. This means that the number of workmen was reduced to less than one half.

EXAMPLE 3

Light weight sheets of rectangular foamed polystyrol were placed in the mould identical to that used in Examples 1 and 2 at a spacing of 2 cm. Expanded metal sheets were applied to both sides of each light weight sheet. Concrete was then poured in the spaces between the sheets and on both sides of the assembly of the sheets to cover the assembly. In this case concrete was poured in the mould to a level about 3 cm lower than the upper edge of the mould. The bottom plate 15 of the bed 12 was not provided with small openings but a sheet of close was placed on the upper surface of the cast concrete. After interconnecting adjacent beds by means of bolts, the interior of the beds was connected to a source of reduced pressure to reduce the pressure in the beds to about 0.1 Kg/cm$^2$. Under this reduced pressure condition mortar was poured in the space (having a depth of about 3 cm) above the cast concrete by using the pressure difference between said reduced pressure and the atmospheric pressure. The reduced pressure is effective to remove the entrained air and excessive moisture to the outside of the paste packing members thus producing products of light weight, and having heat insulating and temperature preserving properties and high mechanical strength.

EXAMPLE 4

In this example the apparatus shown in FIGS. 8, 9 and 10 was used. A coarse aggregate consisting of crushed stones having a dimension of from 10 to 20 mm was packed in respective moulds which were sealed by assembling into a stack. The pressure inside the moulds was reduced to about 0.2 Kg/cm$^2$ and mortar consisting of 803 Kg/cm$^3$ of cement, 803 Kg/m$^3$ of sand and 386 Kg/m$^3$ of water and having a W/C ratio of 46.1 and a flow rate of 20 second was poured into the mould by utilizing the pressure difference between said reduced pressure and the atmospheric pressure. The poured concrete was cured under the same heating and cooling steps as in Example 1. After the curing treatment for 240 minutes, and immediately after releasing from the mould the product showed a compression strength of 120.1 Kg/cm$^2$ which was increased to 170 Kg/cm$^2$ after 7 days and to 290 Kg/cm$^2$ after 4 weeks.

EXAMPLE 5

In this example concrete segments for use in tunnels were prepared by using the apparatus shown in FIG. 11 and by the process steps described in Example 4. Thus, side frames of the mould were packed with coarse aggregate consisting of crushed stones having a size of 10 to 25 mm and then the moulds were assembled into a stack and sealed. The pressure in the moulds was reduced to about 0.2 Kg/cm$^2$ by means of a pressure reducing mechanism and then mortar comprising 1,050 Kg of cement, 610 Kg of sand and 440 Kg of water and having a flow rate of 40 seconds was poured into respective moulds by the pressure difference between the reduced pressure and the atmosphereic pressure. Then the pressure in the mould was increased to 0.7 Kg/cm$^2$. Thereafter the cast cement was heat cured in the same manner as in Example 4. Immediately after releasing from the moulds the products had a compression strength of 250.5 Kg/cm$^2$ which was increased to 352 Kg/cm$^2$ after one week and to 505 Kg/cm$^2$ after 4 weeks. The resulting products are suitable for use as segments for constructing tunnels or other civil works.

EXAMPLE 6

In this example, the apparatus shown in FIGS. 8 to 10 was used. Light weight concrete consisting of a mixture of 600 Kg/m$^3$ of light weight aggregate (produced in the district of Haruna, Japan, and having a specific weight of 0.8 and a grain size of less than 20 mm), 400 Kg/m$^3$ of Portland cement, 540 l/m$^3$ (about 100 Kg/m$^3$) of the light weight aggregate having a grain size of less than 1 mm, 160 Kg/m$^3$ of water and 2 Kg/m$^3$ of a foaming agent and having a W/C ratio of 56% was poured in respective moulds while the pressure in the moulds was reduced to about 0.1 Kg/cm$^2$ by the pressure reducing means 45 shown in FIG. 3.

Then steam was admitted into the beds through distributor 58 for heating the cast concrete to about 100° C. for 120 minutes. This temperature was maintained until 180 minutes and then the cured concrete products were cooled to 72° C. at 210 minutes and to 42° C. at 240 minutes. The uppermost mould was removed by a crane from the assembly. Immediately after releasing from the moulds, the concreteproducts had a compression strength of 80.3 Kg/cm$^2$ which was increased to 132 Kg/cm$^2$ after 7 days. The surface of the products was smooth and flat in all sides.

EXAMPLE 7

The same light weight aggregate as in Example 6 was packed in the side frames 11 of the moulds. Mortar consisting of the mixture of 70 Kg/m$^3$ of the light aggregate having a grain size of less than 1 mm, 533 Kg/m$^3$ of water, 4.8 Kg/m$^3$ of a dispersing agent, 969 Kg/m$^3$ of ordinary cement and having a W/C ratio of 57% was filled in the interstices of the prepacked light weight aggregate under atmospheric pressure. After assembling the moulds as shown in FIGS. 8 to 10, the moulds were heated to 100° C. after 120 minutes by steam supplied through the distributor 58. The temperature of 100° C. was maintained until 190 minutes. Thereafter the cured concrete products were cooled. When cooled to 43° C. after 240 minutes, the uppermost mould was removed from the assembly. Immediately after removal from the mould, the concrete product had a compression strength of about 60 Kg/cm$^2$ which was increased to 80.5 Kg/cm$^2$ after 7 days.

EXAMPLE 8

The same light weight aggregate and light weight mortar as in Example 5 were used. The side frames 11 of the moulds were packed with the light weight aggregate and assembled in a stack as shown in FIGS. 8 to 10 with respective moulds closed by the bottom plates of the overlying beds 12. The pressure in the moulds was reduced to about 0.1 Kg/cm$^2$ by the pressure reducing means 4 for sufficiently removing air in the interstices between the light weight aggregate and in the structure thereof. Then the light mortar was gradually poured under said reduced pressure for impregnating the mortar in the interstices of the aggregate and in the structure thereof. Thereafter, the pressure in the moulds was increased to atmosphereic pressure and then to a pressure of about 1 Kg/cm$^2$.

The cast mortar was heat cured and cooled in the same manner as in Example 5. When the temperature is decreased to 42° C. after 240 minutes, the uppermost mould was removed from the assembly. Immediately after removal from the mould, the concrete product had a compression strength of about 100 Kg/cm$^2$ which was increased to about 150 Kg/cm$^2$.

As has been described hereinabove the invention provides efficient method and apparatus for manufacturing various articles of concrete and other hydraulic substances in a mass production scale having excellent quality.

The invention being thus described, it will be obvious that the same may be varied in many ways. Such variations are not to be construed as a departure from the spirit and scope of the invention, and all such modifications as would be obvious to one skilled in the art are intended to be included within the scope of the following claims.

What is claimed is:

1. A continuous method of sequentially manufacturing articles made of hydraulic cement wherein a plurality of moulds are vertically stacked with a plurality of hollow beds alternately disposed therebetween, said stack having a feed side and a discharge side, said moulds being interconnected for resisting pressure changes and wherein sealing members are interposed between said beds and the moulds throughout the stack for air-tightly closing said moulds, said method consisting essentially of introducing the hydraulic cement into said mould at the feed side of the stack by utilizing the pressure difference between the inside and the outside of the mould, introducing a heating medium into said hollow beds surrounding said moulds for gradually uniformly and indirectly heat curing the poured hydraulic cement from the feed side of the discharge side of said stack, said curing temperature being rapidly increased above 60° C., during which the pressure in the mould is incrreased higher than the expansion pressure of the cement, advancing each mould and adjacent beds by one step at a time through said stack from the feed side to the discharge side thereof, so that each mould occupies the position of the preceding mould as it advances through said stack, the curing of said hydraulic cement taking place at different stages throughout said stack of said moulds, removing one mould containing an article made of hydraulic cement which has been sufficiently cured from the discharge side of said stack of said plurality of moulds and preparing a fresh mould and bed at the feed side of the stack where said mould is recharged with said hydraulic cement, thus continuously manufacturing said articles.

2. The method of claim 1 wherein the hydraulic cement is selected from the group consisting of portland cement, silica cement, alumina cement, blast furnace cement, fly ash cement and slag cement.

3. The method of claim 1 wherein said course aggregate is introduced into the mould at the feed side of the stack before it is filled with said hydraulic substance.

4. The method according to claim 1 wherein the pressure in the mould disposed at the feed side of the stack is reduced and the hydraulic cement is introduced into said mould under the reduced pressure condition.

5. The method according to claim 1 wherein said hydraulic cement is introduced into the mould by applying pressure on said cement.

6. The method according to claim 1 wherein said moulds are prepacked with aggregate before the hydraulic cement is introduced thereinto.

7. The method according to claim 1 wherein a formplate is inserted into said moulds for making various pattern products.

8. The method according to claim 1 wherein the hydraulic cement is at least one member selected from the group consisting of cement mixtures, mortar, plaster and calcium silicate.

9. The method according to claim 1 wherein the hydraulic cement is at least one member selected from the group consisting of portlant cement, alumina cement, silica cement, blast furnace cement, fly ash cement, high-early-strength cement and slag cement.

10. The method according to claim 1 wherein at least one member of reinforcing steel rods, fittings, members adapted to interconnect the products and fibers is disposed in the mould before hydraulic cement is introduced thereinto.

11. The method according to claim 1 wherein means for decreasing the weight of the product is disposed in the mould before hydraulic cement is introduced thereinto.

12. A method of manufacturing articles made of hydraulic cement comprising the steps of preparing at least one substantially airtight, closed mould having sufficient strength to resist the inner pressure produced therein which is increased during the heat-curing of said cement, introducing the hydraulic cement into said mould by utilizing the pressure difference between the inside and the outside of the mould, indirectly and uniformly heat-curing said hydraulic cement in said mould from all sides after said introduction of the cement is completed, the temperature of said curing being rapidly increased in an amount of more than 60° C. during which the pressure in said mould is increased higher than the expansion pressure of the cement, and removing the cured articles from said mould.

13. The method according to claim 12 wherein said closed mould is prepacked with aggregate before the hydraulic cement is introduced thereinto.

14. The method according to claim 12 wherein the pressure in the mould is reduced and the hydraulic cement is introduced into said moulding spaces under reduced pressure conditions.

15. The method according to claim 12 wherein said hydraulic cement is introduced into the mould by applying pressure on said cement.

16. The method according to claim 12 wherein a formplate is inserted into said moulds for making various pattern products.

17. The method according to claim 12 wherein the hydraulic cement is at least one member selected from the group consisting of cement mixtures, mortar, plaster and calcium silicate.

18. The method according to claim 12 wherein the hydraulic cement is at least one member selected from the group consisting of portland cement, alumina cement, silica cement, blast furnace cement, fly ash cement, high-early-strength cement and slag cement.

19. The method according to claim 12 wherein at least one member of reinforcing steel rods, fittings, members adapted to interconnect the products and fibers is disposed in the mould before hydraulic cement is introduced thereinto.

20. The method according to claim 12 wherein means for decreasing the weight of the product is disposed in the mould before hydraulic cement is introduced thereinto.

21. The continuous method of claim 1 wherein during the heat curing a pressure higher than atmospheric pressure is created in the mould which further compacts the poured hydraulic substance.

22. The method of claim 12 wherein during the heat curing a pressure higher than atmospheric pressure is created in the mould which further compacts the poured hydraulic substance.

23. The method of claim 1 wherein the heating medium is steam or hot water.

24. The method of claim 12 wherein the heating medium is steam or hot water.

25. The method of claim 1 wherein the cured hydraulic cement is cooled to harden the hydraulic cement.

26. The method of claim 12 wherein the cured hydraulic cement is cooled to harden the hydraulic cement.

27. The method of claim 11 wherein the means for decreasing the weight of the product compresses blocks of foamed polystyrene.

28. The method of claim 20 wherein the means for decreasing the weight of the product comprises block of foamed polystyrene.

29. The method of claim 4 wherein the pressure in the mould is reduced to about 0.1 $kg/cm^2$.

30. The method of claim 14 wherein the pressure in the mould is reduced to about 0.1 $kg/cm^2$.

31. The method of claim 1 wherein the heat curing is effected by heating at a temperature gradually increasing from ambient temperature up to about 100° C. at a rate of at least about 30° C./hr.

32. The method of claim 12 wherein the heat curing is effected by heating at a temperature gradually increasing from ambient temperature up to about 100° C. at a rate of at least about 30° C./hr.

* * * * *